US009353465B2

(12) United States Patent
Teshima et al.

(10) Patent No.: US 9,353,465 B2
(45) Date of Patent: May 31, 2016

(54) BULKED YARN AND WOUND YARN FOR PRODUCTION OF WOVEN OR KNIT FABRIC, WOVEN OR KNIT FABRIC, AND METHOD FOR PRODUCING THE SAME

(75) Inventors: Koichi Teshima, Osaka (JP); Masami Asano, Anpachi-gun (JP)

(73) Assignees: Kuraray Trading Co., Ltd., Osaka-shi (JP); Asano Nenshi Co., Ltd., Anpachi-gun (JP)

( * ) Notice: Subject to any disclaimer, the term of this patent is extended or adjusted under 35 U.S.C. 154(b) by 236 days.

(21) Appl. No.: 13/642,382

(22) PCT Filed: Apr. 20, 2011

(86) PCT No.: PCT/JP2011/059731

§ 371 (c)(1),
(2), (4) Date: Oct. 19, 2012

(87) PCT Pub. No.: WO2011/132708

PCT Pub. Date: Oct. 27, 2011

(65) Prior Publication Data

US 2013/0037163 A1 Feb. 14, 2013

(30) Foreign Application Priority Data

Apr. 20, 2010 (JP) ..... 2010-096604

(51) Int. Cl.

| | |
|---|---|
| ***D02G 3/40*** | (2006.01) |
| ***D03D 15/00*** | (2006.01) |
| ***D03D 15/06*** | (2006.01) |
| ***D02J 1/02*** | (2006.01) |

(52) U.S. Cl.

CPC . *D02G 3/406* (2013.01); *D02J 1/02* (2013.01); *D03D 15/0077* (2013.01); *D03D 15/06* (2013.01); *D10B 2321/06* (2013.01)

(58) Field of Classification Search

CPC ..... D02G 3/04; D02G 3/406; D03D 15/0077; D03D 15/06

USPC ..... 57/238, 239, 244, 245, 246, 309

See application file for complete search history.

(56) References Cited

U.S. PATENT DOCUMENTS

| | | | | |
|---|---|---|---|---|
| 7,520,121 | B2 * | 4/2009 | Teshima et al. | 57/236 |
| 7,913,483 | B2 * | 3/2011 | Qiu et al. | 57/5 |
| 2005/0132692 | A1 * | 6/2005 | Kim | 57/7 |
| 2007/0214765 | A1 | 9/2007 | Teshima et al. | |
| 2010/0162677 | A1 * | 7/2010 | Qiu et al. | 57/12 |
| 2010/0180563 | A1 * | 7/2010 | Nadkarni et al. | 57/200 |
| 2012/0076971 | A1 * | 3/2012 | Debnath et al. | 428/85 |

FOREIGN PATENT DOCUMENTS

| | | | |
|---|---|---|---|
| EP | 1061162 | A1 * | 12/2000 |
| JP | 62257460 | A * | 11/1987 |
| JP | 2006 144183 | | 6/2006 |
| JP | 2006 225797 | | 8/2006 |
| JP | 2006 328593 | | 12/2006 |
| JP | 2007 154339 | | 6/2007 |
| JP | 2008 25055 | | 2/2008 |
| JP | 4393357 | | 1/2010 |
| KR | 97062870 | A * | 9/1997 |

OTHER PUBLICATIONS

International Search Report Issued Jun. 28, 2011 in PCT/JP11/059731 Filed Apr. 20, 2011.

* cited by examiner

*Primary Examiner* — Shaun R Hurley

(74) *Attorney, Agent, or Firm* — Oblon, McClelland, Maier & Neustadt, L.L.P.

(57) ABSTRACT

Provided is a bulked yarn, comprising a bulked single spun yarn obtained from a composite twisted yarn comprising a single spun yarn and a water-soluble yarn, which are twisted together in a direction opposite to a twisting direction of the single spun yarn, by dissolving and removing the water-soluble yarn in a hydrophilic solvent from the composite twisted yarn. When the bulked yarn having a length of 100 cm is hung down in a state where both ends of the yarn are fixed at a distance of 10 cm from each other in a direction perpendicular to the direction of gravitational force, twisting does not occur or an average value of the distances from the uppermost end of a twisting section to the first and second fixed ends of the yarn is 30 cm or more.

19 Claims, 1 Drawing Sheet

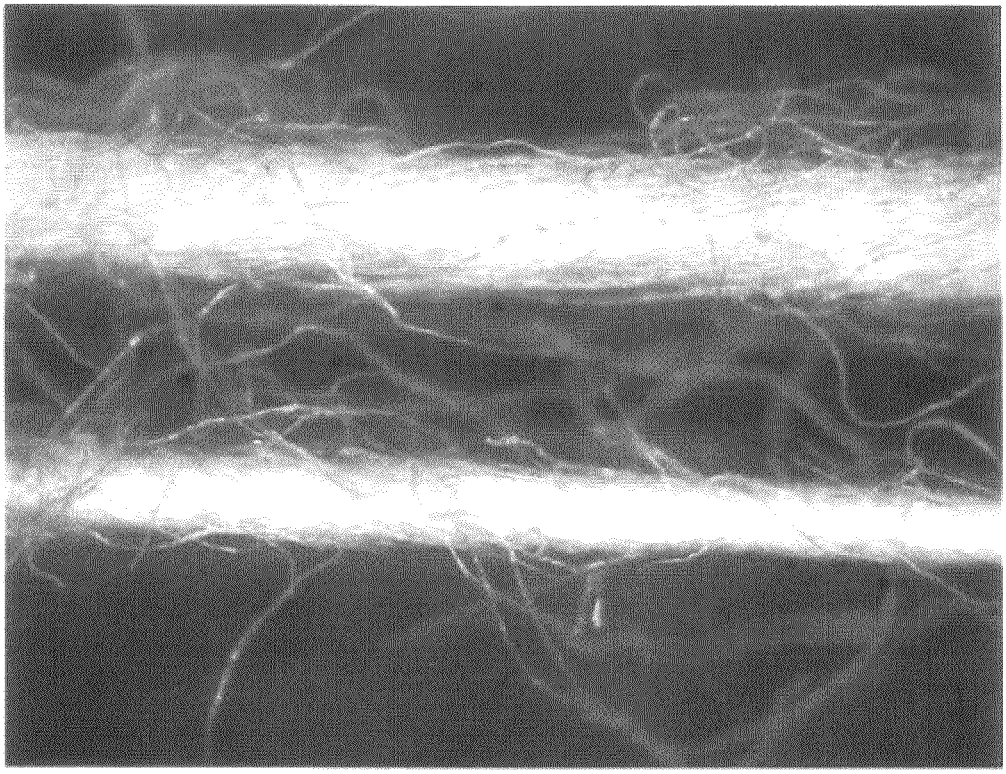

BULKED YARN AND WOUND YARN FOR PRODUCTION OF WOVEN OR KNIT FABRIC, WOVEN OR KNIT FABRIC, AND METHOD FOR PRODUCING THE SAME

TECHNICAL FIELD

The present invention relates to a bulked yarn and a wound yarn for production of a woven or knit fabric, a woven or knit fabric comprising the bulked yarn or wound yarn, and a method for producing the same. More specifically, the present invention relates to a bulked yarn and a wound yarn that are bulkier and better in air permeability, heat-insulating properties, and water absorbency than a typical spun yarn, soft and shed no fluff, and are capable of being subjected to both yarn dyeing and piece dyeing, and a woven or knit fabric comprising the bulked yarn or wound yarn, and a method for producing the same. Further, the present invention relates to a bulked yarn and a wound yarn for production of a woven or knit fabric from which a woven or knit fabric is obtained that is lightweight but voluminous, soft with an excellent touch, excellent in air permeability, heat-insulating properties, water absorbency, and rapid-drying properties, and has excellent durability of these properties, sheds no fluff, and has high anti-pilling properties (fuzzing or disordered fluff), a woven or knit fabric comprising this bulked yarn or wound yarn, and a method for producing the same.

BACKGROUND ART

Production of a woven or knit fabric from a composite yarn composed of a spun yarn and a polyurethane elastic yarn in combination has been actively performed for providing stretch properties and improving texture, lightweight properties, and bulky feel. Typical examples of composite yarns obtained by combining a spun yarn and a polyurethane elastic yarn are a core spun yarn obtained by covering the surrounding of a core thread composed of a polyurethane elastic yarn by spinning cotton and twisting these, a single-covered yarn and a double-covered yarn obtained by winding a spun yarn once or repeatedly around a core thread composed of a polyurethane elastic yarn, and others. When a woven or knit fabric is produced by using these composite yarns, provision of stretch properties and an improvement in voluminosity to some degree are possible, however, in many cases, the woven or knit fabric is insufficient in softness, airy texture, lightweight properties, and bulky feel.

Other than the composite yarns, a method for making a yarn bulky by shrinking the yarn is also known, however, this method is applicable only to yarns using synthetic fiber such as acrylic fiber, and is difficult to apply to cotton fibers, so that this method lacks versatility.

Further, the twists of the spun yarn become a factor that spoils the texture, lightweight properties, and bulky feel, so that production of a woven or knit fabric by using a spun yarn with a reduced number of twists is widely adopted. As a method for reducing the number of twists, there is a method in which a spun yarn is produced by reducing the set number of twists in fine spinning in the spinning process, etc., however, due to the reduced number of twists, pilling and friction (or abrasion) easily occur and fiber that falls out at the time of washing easily increases although the texture is improved.

Further, Japanese Patent Application Laid-Open Publication No. 2006-225797 (JP-2006-225797A, Patent Document 1) and Japanese Patent Application Laid-Open Publication No. 2007-154339 (JP-2007-154339A, Patent Document 2) disclose a method in which a composite twisted yarn is produced by twisting a spun yarn and a water-soluble yarn to the number of twists 0.5 to 1.0 times the number of twists of the spun yarn in an opposite direction to the twisting direction of the spun yarn, a woven or knit fabric is produced by using this composite twisted yarn, and then the water-soluble yarn is dissolved. However, with this method, although a woven or knit fabric with good texture is obtained, lightweight properties and bulkiness cannot be sufficiently obtained due to the crossing points of the yarns and interlace portions (e.g., contacts between warp yarns and weft yarns in a woven fabric, overlapping portions of loops in a knit fabric), so that pilling and friction easily occur, and fiber that falls out at the time of washing easily increases.

On the other hand, Japanese Patent No. 4393357 (JP-4393357B, Patent Document 3) discloses a composite twisted yarn produced by twisting a spun yarn and a water-soluble yarn to the number of twists 1.3 to 3 times the number of twists of the spun yarn in an opposite direction to the twisting direction of the spun yarn, and a woven or knit fabric produced by providing a woven or knit fabric composed of the composite yarn and then dissolving and removing the water-soluble yarn in water. This woven or knit fabric is excellent in texture, lightweight properties, and air permeability, and has stretch properties.

However, this composite yarn includes a water-soluble yarn, and a twisting torque thereof is so great that the composite yarn cannot be used for weaving and knitting, therefore, it requires a heat-setting process such as steam setting and a process for removing the water-soluble yarn dissolved by heat setting. Further, even if the yarn is subject to heat setting, warping properties and weaving and knitting properties thereof are not sufficient, and for example, when yarn breakage occurs during weaving, the tension generates a torque and causes the yarn to twist (curl), and it is difficult to restart the weaving/knitting machine. Further, due to the strong torque, for example, if the yarn is used for single knitting, welt skew occurs, and fine knitting is difficult, and yarn breakage easily occurs.

The water-soluble yarn is included in the composite twisted yarn, so that twisted yarns adhere to each other according to heat setting, and if the composite twisted yarn is preserved in the form of a wound yarn for a long period of time, twisted yarns easily adhere to each other, so that the preservation stability is low particularly in a humid environment.

When a dyed yarn is used, a composite twisted yarn is made of the dyed yarn and a water-soluble yarn, and after a woven or knit fabric is produced by using this composite twisted yarn, the water-soluble yarn must be dissolved and removed, however, in the removal by dissolution, the color of the dyed yarn may change or fade, and in particular, it is difficult to remove by dissolution the water-soluble yarn at 95° C. from a woven or knit fabric containing the water-soluble yarn and a cotton yarn directly colored with a dye.

Further, in the method in which the water-soluble yarn in the woven or knit fabric is removed, the water-soluble yarn is removed by dissolution in a state where the composite twisted yarn is confined (or bound) within the woven or knit fabric, so that lightweight properties and bulkiness are not sufficient at crossing points and interlace portions of the yarns in the woven or knit fabric.

RELATED ART DOCUMENTS

Patent Documents

Patent Document 1: JP-2006-225797A
Patent Document 2: JP-2007-154339A
Patent Document 3: JP-4393357B

SUMMARY OF THE INVENTION

Problems to be Solved by the Invention

It is an object of the present invention to provide a bulked yarn and a wound yarn having excellent texture, lightweight properties, and anti-pilling properties, as well as excellent weaving and knitting properties and productivity, a woven or knit fabric comprising the bulked yarn or wound yarn, and a method for producing the same.

Another object of the present invention is to provide a bulked yarn and a wound yarn that has excellent preservation stability, and can be preserved for a long period of time in a humid environment, a woven or knit fabric comprising the bulked yarn or wound yarn, and a method for producing the same.

It is still another object of the present invention to provide a bulked yarn and a wound yarn to be suitably used for both of a weaving and knitting method using a dyed yarn and a method in which a woven or knit fabric is produced and then dyed, a woven or knit fabric comprising the bulked yarn or wound yarn, and a method for producing the same.

It is a further object of the present invention to provide a woven or knit fabric comprising a bulked yarn or a wound yarn that is lightweight but voluminous, soft with an excellent touch, excellent in heat-insulating (or heat-retaining) properties, air permeability, water absorbency, and anti-pilling properties, and has excellent durability of these properties, and a method for producing the same.

It is a still further object of the present invention to provide a woven or knit fabric comprising a bulked yarn or a wound yarn, from which a woven or knit fabric that sheds (or falls) no fluff and has excellent water absorbency and rapid-drying properties can be produced, and a method for producing the same.

It is another object of the present invention to provide woven or knit fabrics comprising the respective spun yarns with any count (thicknesses) from fine count yarns to low count yarns that are applicable as various spun yarns such as spun yarns of natural fibers, spun yarns of synthetic fibers, and spun yarns of semisynthetic yarns, and are adaptable to small lot and large variety production.

A still another object of the present invention is to provide a method for producing a woven or knit fabric that is lightweight but voluminous, soft with an excellent touch, has excellent heat-insulating properties and anti-pilling properties, has excellent durability of these properties, and sheds no fluff and is excellent in absorbency and rapid-drying properties.

Means to Solve the Problems

The invention previously developed by the inventors of the present invention and described in Patent Document 3 is an invention providing a woven or knit fabric that is bulky and stretchable obtained by removing a water-soluble yarn in the woven or knit fabric by dissolution in water after the woven or knit fabric is produced from a specific composite twisted yarn composed of a spun yarn and the water-soluble yarn; at the time of application of that invention, the inventors of the present invention considered that it was impossible to smoothly perform a weaving and knitting process for producing a woven or knit fabric without the form of a composite twisted yarn obtained by twisting a spun yarn and a water-soluble yarn. That is, at that time, the water-soluble yarn was dissolved in the state of cloth since the dissolution of the water-soluble yarn could be performed concurrently with a cloth scouring process, and this was easy for performing the processes. On the other hand, a person skilled in the art considered that a sufficient bath ratio and a space for bulking were necessary to obtain sufficient texture, and neither performed nor conceived dissolution of the water-soluble yarn in the state of a twisted yarn.

However, after a great deal of consideration, the inventors of the present invention unexpectedly found that when a water-soluble yarn was removed by dissolution in a hydrophilic solvent from a specific composite twisted yarn including a single spun yarn before producing a woven or knit fabric, a bulked yarn that bulked more greatly and had a smaller torque than the composite twisted yarn before the water-soluble yarn was removed, was obtained, the texture, lightweight properties, and anti-pilling properties of the yarn could be improved as well as weaving and knitting properties and productivity. The present invention was accomplished based on the above findings.

That is, a bulked yarn according to the present invention is a bulked yarn including a bulked single spun yarn obtainable from a composite twisted yarn in which a single spun yarn and a water-soluble yarn are twisted together in a direction opposite to the twisting direction of the single spun yarn by dissolving and removing the water-soluble yarn in a hydrophilic solvent from the composite twisted yarn, and when the bulked yarn with a length of 100 cm is hung down in a state where both ends (first and second ends) of the yarn are fixed at a distance of 10 cm from each other in the direction perpendicular to the direction of gravitational force, twisting does not occur or the average value of the distances from the uppermost end of a twisting section (entwining portion) to the first and second (left and right) fixed ends of the yarn is 30 cm or more.

The bulked yarn according to the present invention may be a raw yarn for producing a woven or knit fabric. The diameter of the bulked single spun yarn may be 1.2 or more times the diameter of the single spun yarn before bulking. The bulked yarn according to the present invention may be a bulked yarn that is usable without heat treatment for reducing the torque. The B value expressed by the following equation of the bulked yarn according to the present invention may be 3 to 8.

$$B=(N2/N1)\times(D2/D1)^2$$

In the equation, N1 is the number of twists of the single spun yarn, N2 is the number of twists of the composite twisted yarn, D1 is an average diameter of the single spun yarn, and D2 is an average diameter of the bulked single spun yarn.

The bulked yarn according to the present invention may consist essentially of the bulked single spun yarn. The bulked yarn according to the present invention may be a bulked yarn obtainable by doubling or twisting the two or more composite twisted yarns together, and then dissolving and removing the water-soluble yarns in a hydrophilic solvent from the composite twisted yarns. The bulked yarn according to the present invention may be a bulked yarn obtainable by doubling or twisting the one or more composite twisted yarns and one or more other yarns together, and then dissolving and removing the water-soluble yarns in the hydrophilic solvent from the composite twisted yarns.

In the bulked yarn according to the present invention, the number of twists of the composite twisted yarn may be about 1.3 to 3 times the number of twists of the single spun yarn, and the ratio (mass ratio) of the single spun yarn relative to the water-soluble yarn may be about 98/2 to 20/80 in a ratio of the former/the latter.

The present invention also includes a wound yarn in which the bulked yarn is wound into a skein or tube shape, and a woven or knit fabric including the bulked yarn. In the woven or knit fabric according to the present invention, the proportion of the bulked yarn may be 10 mass % or more. The woven or knit fabric according to the present invention may include the bulked yarn as a pile yarn.

The present invention also includes a method for producing the bulked yarn, the method comprising providing a composite twisted yarn in which a single spun yarn and a water-soluble yarn are twisted together in a direction opposite to the twisting direction of the single spun yarn and dissolving and removing the water-soluble yarn in a hydrophilic solvent from the composite twisted yarn. Further, the present invention also includes a method for producing a woven or knit fabric, which comprises weaving or knitting the bulked yarn as a raw yarn; and a method for yarn dyeing a yarn, which comprises yarn dyeing the bulked yarn.

Effects of the Invention

According to the present invention, before producing a woven or knit fabric, a water-soluble yarn is removed by dissolution in a hydrophilic solvent from a specific composite twisted yarn itself including a single spun yarn, so that a bulked yarn is obtained that greatly bulks and has a small torque as compared with the single spun yarn included in the composite twisted yarn before removal of the water-soluble yarn, and has excellent texture, lightweight properties, and anti-pilling properties as well as improving weaving and knitting properties and productivity.

The bulked yarn according to the present invention has excellent preservation stability and can be preserved for a long period of time, particularly, even in a humid environment since a water-soluble yarn is removed therefrom. Further, the process for removing the water-soluble yarn from a dyed woven or knit fabric is not necessary, so that the bulked yarn is suitably used for both of a method in which a yarn dyed in advance (dyed yarn) is woven or knitted and a method in which a woven or knit fabric is produced and then dyed, and therefore, various woven or knit fabric products can be smoothly produced by using the bulked yarn according to the present invention.

In particular, the bulked yarn according to the present invention is lightweight but voluminous, soft with an excellent touch, and excellent in heat-insulating (or heat-retaining) properties, air permeability, water absorbency, and anti-pilling properties, and has excellent durability of these properties.

Further, a woven or knit fabric containing this bulked yarn is more lightweight, more voluminous, softer with an excellent touch, and better in heat-insulating properties and air permeability, has greater anti-pilling properties, sheds no fluff, and has better rapid-drying properties despite having great water absorbency than the woven or knit fabric obtained by removing the water-soluble yarn in the woven or knit fabric by dissolution in a hydrophilic solvent. In addition, durability of these properties is excellent, and voluminosity of the woven or knit fabric when the fabric is new is not lost even after repeated washing, and high voluminosity is maintained, and the properties including softness, heat-insulating properties, air permeability, water absorbency, and rapid-drying properties can be maintained for a long period of time.

In the present invention, in the production of a composite twisted yarn before removal of the water-soluble yarn by dissolution, the above-described properties are developed by using a single yarn (single spun yarn). For example, if a composite twisted yarn is produced by twisting two or more spun yarns such as two ply yarns (or two-folded yarns), three ply yarns (or three-folded yarns), or four ply yarns (or four-folded yarns) and a water-soluble yarn in the obtained composite twisted yarn is removed by dissolution in water, a spun yarn sufficiently bulked cannot be obtained, and when a woven or knit fabric is produced by using this yarn, the properties including the lightweight properties, voluminosity, softness, touch, water absorbency, and rapid-drying properties of the fabric cannot be improved.

The bulked yarn according to the present invention is applicable as various spun yarns to be used for producing a composite twisted yarn from which a water-soluble yarn will be removed, such as spun yarns made of natural fibers such as cotton fibers, hemp fibers, and wool fibers, spun yarns made of synthetic fibers, and spun yarns made of semisynthetic fibers, and adaptable to small lot and large variety production, and woven or knit fabrics using the respective spun yarns with any count (thicknesses) from fine count yarns to low count yarns are obtained.

The bulked yarn according to the present invention can also be obtained by doubling or twisting a plurality of yarns composed of the composite twisted yarns or a combination with other yarn, and all of these yarns greatly bulk as compared with the single spun yarn included in the composite twisted yarn before removal of a water-soluble yarn, and are soft with an excellent touch, and excellent in air permeability, heat-insulating properties, and water absorbency, sheds no fluff, and can be used as a yarn to be woven or knitted without a problem.

BRIEF DESCRIPTION OF THE DRAWINGS

FIG. 1 is an electronmicrograph of a bulked yarn and a single spun yarn used for producing a composite twisted yarn in Example 1, and the upper yarn is the bulked yarn, and the lower yarn is the single spun yarn.

DESCRIPTION OF EMBODIMENTS

[Bulked Yarn]

A bulked yarn according to the present invention includes a bulked single spun yarn subjected to bulking. Specifically, a bulked yarn according to the present invention includes a bulked single spun yarn obtainable by providing a composite twisted yarn in which a single spun yarn and a water-soluble yarn are twisted together in an opposite direction to the twisting direction of the single spun yarn and dissolving the water-soluble yarn in a hydrophilic solvent to remove the water-soluble yarn from the composite twisted yarn.

(Single Spun Yarn)

In the bulked yarn according to the present invention, a spun yarn that constitutes a composite twisted yarn before a water-soluble yarn is removed from the composite twisted yarn by dissolution must be "single yarn" as it was spun by using fibers (raw cotton) (that is, single spun yarn). If the spun yarn constituting the composite twisted yarn is a spun yarn obtained by twisting two or more spun yarns such as two ply yarns, three ply yarns, or four ply yarns, even when a water-soluble yarn in the composite twisted yarn produced by twisting these spun yarns and the water-soluble yarn is removed by dissolution in a hydrophilic solvent, a spun yarn remaining after the removal of the water-soluble yarn still has twists, so that it is less bulky, inferior in lightweight properties, heat-insulating properties, water absorbency, and other properties, poor in soft texture, and therefore, the object of the present invention cannot be achieved.

The single spun yarn is not particularly limited to a specific one, and is any of synthetic fiber, semisynthetic fiber, regenerated fiber, and natural fiber as far as the single spun yarn is a single spun yarn formed from fiber insoluble in water (hot water, warm water, and cold water) (that is, a single spun yarn as it was spun by using the above-mentioned fibers).

The synthetic fiber may include, for example, a polyester-series fiber (e.g., a poly($C_{2-4}$alkylene arylate) fiber such as a polyethylene terephthalate fiber, a polytrimethylene terephthalate fiber, a polybutylene terephthalate fiber, or a polyethylene naphthalate fiber), a polyamide-series fiber (e.g., an aliphatic polyamide-series fiber such as a polyamide 6 or a polyamide 66), a polyolefin-series fiber (e.g., a poly($C_{2-4}$ olefin) fiber such as a polyethylene or a polypropylene), an acrylic fiber (e.g., an acrylonitrile fiber), a water (hot water)-insoluble polyvinyl alcohol-series fiber (e.g., an ethylene-vinyl alcohol-series copolymer fiber), a polyvinyl chloride-series fiber (e.g., a polyvinyl chloride), and a polyvinylidene chloride-series fiber. The semisynthetic fiber may include, for example, an acetate fiber such as a triacetate fiber. The regenerated fiber may include, for example, rayon, polynosic, cupra, and lyocell (for example, registered trademark "Tencel"). The natural fiber may include, for example, cotton, wool, silk, and hemp.

These fibers may be used singly or in combination of two or more kinds. In particular, the spun yarn is not limited to a single spun yarn selected from these fibers, and may be a blended spun yarn of two or more kinds of fibers (for example, a blended spun yarn of polyester fiber and cotton). These fibers may suitably be selected according to the bulked yarn and the use of a woven or knit fabric to be produced by using the bulked yarn. Fiber to be widely used includes, for example, a synthetic fiber such as a polyamide-series fiber, a polyester-series fiber, and an acrylic fiber, a semisynthetic fiber such as an acetate fiber, a regenerated fiber such as rayon or cupra, and a natural fiber such as cotton, wool, or silk. In particular, the synthetic fiber such as a polyester-series fiber and the natural fiber such as cotton or wool are preferably used, and the natural fiber such as cotton is particularly preferable since it is excellent in yarn strength and versatility, and has excellent texture.

The number of twists of the single spun yarn is not particularly limited to a specific one. When T is the number of twists (unit: twists/2.54 cm) and S is the cotton count (unit: count), a single spun yarn whose twist coefficient K expressed by $K=T/\sqrt{S}$ is, for example, about 1.5 to 5, preferably about 2 to 4, and more preferably, about 2.5 to 3.5 is preferably used from the viewpoint of quality stability of the single spun yarn, productivity in production of a composite twisted yarn, and availability of the spun yarn, or others. The detailed number of twists may be, for example, about 200 to 2000 twists/m, preferably about 250 to 1500 twists/m, and more preferably about 300 to 1200 twists/m (particularly preferably, about 400 to 1000 twists/m).

The fineness (average fineness) of the single spun yarn is not particularly limited to a specific one, and is, for example, about 5 count to 20 count (about 50 to 1180 dtex), preferably about 6 count to 80 count (about 74 to 980 dtex), and more preferably, about 10 count to 60 count (about 98 to 590 dtex) in terms of yarn count (tex), from the viewpoint of availability and usability in various woven or knit fabrics.

(Water-Soluble Yarn)

The water-soluble yarn constituting the composite twisted yarn is not particularly limited to a specific one as far as it is soluble in a hydrophilic solvent. In particular, a yarn soluble in water (hot water) at a temperature up to a water boiling temperature (about 100° C.) at an atmospheric pressure is used. A woven or knit fabric obtained from a composite twisted yarn including such a water-soluble yarn allows the water-soluble yarn to be easily removed by dissolution in a hydrophilic solvent such as water, and is excellent in operability and the like. In particular, as the water-soluble yarn, a water-soluble yarn 85 mass % or more (specifically, 95 mass % or more) of which dissolves in hot water at a temperature of 80° C. or higher (particularly 90° C. or higher) when it is immersed alone in the hot water and left for 30 minutes with respect to the mass of the water-soluble yarn before it is immersed, is preferably used (a water-soluble yarn whose water-insoluble residue is less than 15 mass %, in particular, less than 5 mass %). If the water solubility of the water-soluble yarn is low, even when a woven or knit fabric produced by using the composite twisted yarn is treated with a hydrophilic solvent such as water, the water-soluble yarn in the composite twisted yarn cannot be sufficiently dissolved and removed, so that a bulked yarn from which a woven or knit fabric being lightweight but voluminous, and very soft with an excellent touch can be produced is difficult to obtain.

The fiber constituting the water-soluble yarn is not particularly limited to a specific one as far as the fiber satisfies the above-mentioned water solubility. For example, a fiber comprising a water-soluble resin can be used. The water-soluble resin may include, for example, a cellulose-series resin (e.g., a hydroxy$C_{2-3}$alkylcellulose such as a hydroxyethylcellulose) a polyvinyl-series resin (e.g., a polyvinyl pyrolidone, a polyvinyl ether, a polyvinyl alcohol, and a polyvinyl acetal), an acrylic copolymer or an alkali metal salt thereof (e.g., a copolymer including a unit comprising an acrylic monomer such as (meth) acrylic acid, a hydroxyl-containing (meth) acrylate, a water-soluble polyamide-series resin (e.g., a polyamide having a polyoxyethylene unit, and a polyamide into which groups such as sulfonate groups or hydroxyl groups are introduced), and a water-soluble polyester-series resin (e.g., a polyester having a polyoxyethylene unit, and a polyester into which groups such as sulfonate groups or amino groups are introduced). These water-soluble resins may be used singly or in combination of two or more kinds.

Among these, a polyvinyl-series resin and a water-soluble polyamide-series resin are preferably used. In particular, from the viewpoint of fiber strength, high solubility in water (hot water), biodegradability, availability, and others, a water-soluble polyvinyl alcohol-series resin and a water-soluble ethylene-vinyl alcohol copolymer resin are preferably used. The water-soluble ethylene-vinyl alcohol copolymer resin may be a polyvinyl alcohol resin obtained by reducing the degree of polymerization to about 200 to 800 (particularly, about 250 to 500) and polymerizing about 3 to 20 mole percent (particularly, about 3 to 15 mole percent) of olefins (particularly, e.g., an $\alpha$-$C_{2-10}$ olefin such as ethylene). The water-soluble polyvinyl alcohol fiber is conventionally widely known, and is commercially available as, for example, a water-soluble vinylon. In particular, a water-soluble polyvinyl alcohol-series fiber and a water-soluble ethylene-vinyl alcohol copolymer fiber are biodegradable, so that waste liquid generated when the polyvinyl alcohol-series fiber and the ethylene-vinyl alcohol copolymer fiber are removed from the composite twisted yarn by dissolution in water can be smoothly microbially treated and purified.

The water-soluble yarn may be a spun yarn or filament yarn (long fiber) as far as the yarn is water-soluble. A filament yarn is preferably used since the filament is easily removed by dissolution in a hydrophilic solvent. Further, a multi-filament yarn is particularly preferable since the water-soluble yarn can be quickly and satisfactorily dissolved and removed by treating the composite twisted yarn with a hydrophilic solvent such as water even if the composite twisted yarn has a low blend ratio of the water-soluble yarn, a fine count single spun yarn can be easily used, and the blend ratio of the water-soluble yarn in the composite twisted yarn can be reduced and the cost can be reduced.

The fineness of the water-soluble yarn is, for example, about 15 to 200 dtex, preferably about 20 to 150 dtex, and more preferably, about 25 to 100 dtex (particularly preferably about 30 to 80 dtex) from the viewpoint of easiness of twisting with a single spun yarn, easiness of removal by dissolution of the water-soluble yarn from the composite twisted yarn, and productivity of the water-soluble yarn.

In the present invention, the reason that not a yarn soluble or decomposable in alkali or acid but a yarn (water-soluble yarn) soluble in a hydrophilic solvent such as water is used as a yarn to be removed in the composite twisted yarn is that although there is a possibility that the single spun yarn constituting the composite twisted yarn is degenerated or decomposed if a part of the composite twisted yarn is removed by alkali or acid, there is no possibility that the single spun yarn is degenerated or decomposed when the composite twisted yarn is treated with a hydrophilic solvent such as water (particularly water). In the present invention, use of such a water-soluble yarn allows use of various single spun yarns as a single spun yarn constituting the composite twisted yarn. That is, in the present invention, as a spun yarn constituting the composite twisted yarn, a yarn that is easily dissolved or decomposed by alkali or acid can also be used as far as the yarn is not soluble in a hydrophilic solvent such as water, and the range of choices of the kind of the spun yarn constituting the composite twisted yarn is widened, and eventually, the range of choices of the kind, properties, and texture of a woven or knit fabric formed from the spun yarn (bulked yarn) bulked by removing the water-soluble yarn by dissolution in a hydrophilic solvent such as water from the composite twisted yarn is also widened.

The ratio (mass ratio) of the single spun yarn relative to the water-soluble yarn may for example be about 98/2 to 20/80, preferably about 95/5 to 30/70, and more preferably, about 90/10 to 50/50 (particularly preferably about 90/10 to 70/30) in a ratio of the former/the latter.

By setting the ratio of the spun yarn to the water-soluble yarn within the above-described range, the bulked yarn obtained by dissolving and removing the water-soluble yarn in water from the composite twisted yarn becomes excellent in properties such as bulkiness, texture, lightweight properties, heat-insulating properties, softness, weaving and knitting properties, and twist stability, and a woven or knit fabric obtainable from this bulked yarn is lightweight but voluminous, very soft with an excellent touch, excellent in heat-insulating properties and water absorbency, and has durability of these properties, and sheds no fluff and has high anti-pilling properties.

If the proportion of the water-soluble yarn in the composite twisted yarn is excessively low, the texture, lightweight properties, bulkiness of the bulked yarn, and others, are deteriorated, and the bulked yarn easily becomes hard and inferior in texture. On the other hand, if the proportion of the water-soluble yarn in the composite twisted yarn is excessively high, the shape stability of the bulked yarn is deteriorated, and the weaving and knitting properties are deteriorated.

(Twist Properties of Composite Twisted Yarn)

In the composite twisted yarn, as setting of the number of single spun yarns and the number of water-soluble yarns (the number of yarns), the number of single spun yarns must be 1, and the number of water-soluble yarns is preferably 1 to 3 (particularly preferably 1 or 2) from the viewpoint of the textures, lightweight properties, and bulkiness of the bulked yarn and woven or knit fabric, limitation in creel capacity of a yarn twisting machine, and quality control.

In the composite twisted yarn to be used in the present invention, the twisting direction of the composite twisted yarn (direction of twisting two kinds of yarns of a spun yarn and a water-soluble yarn) (final twists) is opposite to the twisting direction of the single spun yarn constituting the composite twisted yarn (first twists).

Further, the number of twists of the composite twisted yarn is about 1.3 to 3 times the number of twists of the single spun yarn. That is, the number of twists N2 (unit: twists/m) of the composite twisted yarn is within the range of 1.3 to 3 times the number of twists N1 (unit: twists/m) of the single spun yarn (that is, N2/N1=1.3 to 3). With respect to torque reduction and an improvement in texture of the twisted yarn, the twisting direction of the final twists is conventionally set to be opposite to the twisting direction of the first twist, however, in such a case, conventionally, the number of final twists is about 0.3 to 0.9 times the number of first twists, and further, the number of final twists is generally smaller than the number of first twists. In contrast, in the composite twisted yarn used in the present invention, the number of final twists (the number of twists N2 of the composite twisted yarn) set to be larger than the number of first twists (the number of twists N1 of the single spun yarn), and the ratio of both number of twists (N2/N1) set in a specific range from 1.3 to 3 are greatly different from those in the conventional technology described above in which the number of final twists is smaller than the number of first twists.

In the composite twisted yarn, the number of final twists is 1.3 to 3 times the number of first twists, so that at the time of doubling and twisting (when carrying out final twists) for producing the composite twisted yarn, the final twists act in a direction of untwisting the twists (first twists) of the single spun yarn while maintaining the shape stability (twist stability) of the composite twisted yarn, and at the time of final twisting, the yarn length of the single spun yarn becomes long. Further, the single spun yarn is twisted with a water-soluble yarn in an opposite direction to the twisting direction of the single spun yarn to form a composite twisted yarn, however, the fiber (raw fiber) constituting the single spun yarn keeps the original twisting direction of the first twists while being untwisted (it is presumed that the reason the raw fiber of the single spun yarn keeps the original twists is that untwisting is physically suppressed by the water-soluble yarn). Therefore, at the time of final twisting, raw fiber of the single spun yarn is realigned. Further, in the case where the water-soluble yarn is a spun yarn and the twisting direction thereof is opposite to the twisting direction of the single spun yarn or in the case where the water-soluble yarn is a filament yarn, yarn twisting is performed in a state where the relationship of [yarn length of single spun yarn]>[yarn length of a water-soluble yarn] is kept. Then, when the water-soluble yarn is removed by dissolution in a hydrophilic solvent such as water from the composite twisted yarn, in a single spun yarn twisted in the opposite direction to the original twisting direction in the composite twisted yarn in a state where a torque is applied in the original twisting direction of the single spun yarn, repulsion occurs in raw fiber constituting the single spun yarn. That is, it is presumed that the raw fiber of the single spun yarn in the original twisted state repels in the twisting direction of the composite twisted yarn and bulks according to dissolution of a water-soluble yarn that has bound the twists. As a result, the single spun yarn bulks, so that a bulked yarn that is excellent in texture, lightweight properties, heat-insulating properties, water absorbency, and other properties, and has excellent durability of these properties, is obtained.

If the number of final twists in the composite twisted yarn is excessively smaller than the number of first twists, at the time of doubling and twisting for producing the composite twisted yarn, untwisting of the single spun yarn is insufficient, and a yarn length for obtaining sufficient bulkiness, lightweight properties, heat-insulating properties, and water softness, etc., at the time of removal of the water-soluble yarn by dissolution in water, cannot be obtained, and a bulked yarn excellent in texture, lightweight properties, softness, heat-insulating properties, and water absorbency cannot be obtained. On the other hand, the number of final twists excessively larger than the number of first twists is not preferable since trouble such as yarn breakage is caused in the yarn twisting process for final twisting (doubling and twisting for producing the composite twisted yarn), and the productivity of the composite twisted yarn is deteriorated.

Further, in the composite twisted yarn, the number of final twists is preferably 1.4 to 3 times the number of first twists (N2/N1=1.4 to 3), and particularly preferably 1.5 to 2 times (N2/N1=1.5 to 2).

It is sufficient that the ratio of the number of twists of the composite twisted yarn (the number of final twists) relative to the number of twists of the spun yarn may be within the above-described range. For example, the number of twists of the composite twisted yarn may be preferably about 50 to 3000 twists/m, preferably about 100 to 2500 twists/m, and more preferably about 200 to 2000 twists/m (particularly preferably about 300 to 1800 twists/m).

In this description, "the number of twists of the composite twisted yarn" (the number of final twists) means the number of twists when the single spun yarn and the water-soluble yarn are twisted together, and in actuality, the value thereof is equivalent to a set number of twists set in the yarn twisting process.

The composite twisted yarn is formed by twisting (final-twisting) a single spun yarn and a water-soluble yarn. The kind of the yarn twisting machine to be used for producing the composite twisted yarn is not particularly limited to a specific one, and is, for example, a general yarn twisting machine such as a double twister, a ring twister, or an up twister.

(Water-Soluble Yarn Extraction Treatment)

In the present invention, by extracting (removal by dissolution) the water-soluble yarn in the composite twisted yarn by using a hydrophilic solvent, a bulked yarn that is lightweight but voluminous is obtained. The composite twisted yarn to be subjected to the extraction treatment is not limited to a composite twisted yarn formed of a bulked single spun yarn alone, and may be a yarn including a composite twisted yarn, for example, a yarn obtained by doubling or twisting two or more composite twisted yarns or doubling or twisting one or more composite twisted yarns and one or more other yarns.

The adoptable extraction treatment may include extraction treatment in a state where a composite twisted yarn (or yarn including a composite twisted yarn) is wound around a skein, extraction treatment in a state where the composite twisted yarn is wound into a cheese shape around a bobbin for dyeing, or extraction treatment in a state where the composite twisted yarn is wound around a dyeing beam.

Among these methods, extraction treatment in a state where the composite twisted yarn is wound into a cheese shape is preferable because this enables efficient small lot production. In the extraction treatment in a state where the composite twisted yarn is wound into a cheese shape, upon adjusting the fiber density when dissolving the water-soluble yarn to about 0.1 to 0.7 g/cm$^3$ (particularly about 0.2 to 0.5 g/cm$^3$) and winding the composite twisted yarn or the yarn including a composite twisted yarn into a cheese shape, the water-soluble yarn is removed by dissolution in water, and accordingly, a bulked yarn that sufficiently bulks and has excellent texture, lightweight properties, heat-insulating properties, softness, and other properties, is obtained. If the fiber density of the cheese-shaped wound yarn is excessively low, the winding easily falls apart before and after the extraction treatment and during the treatment. If the density is excessively high, the water-soluble yarn included in the yarn wound at the inner side is not dissolved and remains, or even though it is dissolved, the spaces between the fibers are small, so that bulkiness is insufficient, and the texture, lightweight properties, heat-insulating properties, and other properties are easily deteriorated.

The hydrophilic solvent may include, as well as water, an alcohol (such as methanol, ethanol, or isopropanol), a ketone (such as acetone), an ether (such as tetrahydrofuran), a cellosolve (such as methyl cellosolve or ethyl cellosolve), and a carbitol (such as carbitol or diethyleneglycol dimethyl ether). These hydrophilic solvents may be used singly or in combination of two or more kinds. Among these hydrophilic solvents, for example, water, a $C_{1-3}$alcohol such as ethanol, a ketone such as acetone, and a mixed solvent of water and another hydrophilic solvent are preferably used, and water is usually employed.

The method for extracting the water-soluble yarn is not particularly limited to a specific one. A method using immersion in a hydrophilic solvent of a high temperature may be adopted since this method is simple and enables efficient removal of the water-soluble yarn. When water is used as the hydrophilic solvent, the extraction water may be neutral, alkali, or acid aqueous solution. Alternatively, an aqueous solution to which a surfactant or the like is added may be used.

The extraction treatment temperature can be adjusted according to the kind of fiber constituting the water-soluble yarn, the solubility in the solvent, the form and thickness of the yarn, and others. From the viewpoint of removal efficiency, the extraction treatment is preferably performed at a temperature equal to or higher than the temperature at which dissolution rapidly starts (dissolution temperature) (particularly preferably a temperature 5 to 20° C. higher than, more particularly preferably 10 to 20° C. higher than the dissolution temperature). When a water-soluble yarn is formed of a water-soluble polyvinyl alcohol-based fiber having a water dissolution temperature of 80° C., the water-soluble yarn can be quickly removed from the composite twisted yarn in a short time by treatment using water at a temperature of 85 to 100° C. If the treatment temperature is excessively low, the extractability of the water-soluble yarn is not sufficient, and the productivity is deteriorated. If the treatment temperature is excessively high, the dissolution time of the water-soluble yarn becomes extremely short, and the quality of woven or knit fabric is also easily deteriorated.

The amount of the hydrophilic solvent is twice or more (in mass) that of the composite twisted yarn, and is, for example, about 2 to 1000 times, preferably about 3 to 100 times, and more preferably about 5 to 50 times that of the composite twisted yarn. If the amount of the hydrophilic solvent is excessively small, removal of the water-soluble yarn is insufficient. If the extraction and removal are insufficient, the water-soluble yarn may be extracted and removed again in a hydrophilic solvent that is fresh and does not contain the water-soluble yarn.

The extraction treatment time can also be properly adjusted according to use, the apparatus used, and treatment temperature, and from the view point of production efficiency, stability, and quality and performance of obtained woven or knit fabric, the extraction treatment time is, for example, about 1 to 300 minutes, preferably about 3 to 200 minutes, and more preferably about 5 to 100 minutes (particularly preferably about 10 to 60 minutes).

The treatment machine for performing the extraction treatment is not particularly limited to a specific one. The water-soluble yarn can be efficiently removed by dissolution by using a pot of a yarn dyeing machine. In the case where a pot of a yarn dyeing machine is used, it is possible that subsequent to the removal by dissolution of the water-soluble yarn, thus obtained bulked yarn is dyed by using the same pot.

After the water-soluble yarn is removed by dissolution from the composite twisted yarn or yarn including the composite twisted yarn, the yarn is preferably washed with water to remove the components of the water-soluble yarn adhering to the yarn.

The bulked single spun yarn (bulked yarn) thus subjected to bulking may be subjected to dyeing treatment, treatment for applying an oil solution for lubrication, water-repellent finishing, treatment for applying a functional processing agent for providing an antibacterial effect or other effects, and yarn processing such as doubling and twisting according to use under the conditions that do not deteriorate the bulkiness, lightweight properties, heat-insulating properties, water absorbency, texture, and other properties. In particular, the bulked yarn according to the present invention is obtained through the extraction treatment in which the color of the dyed yarn easily changes or fades, so that the bulked yarn is suitable for the method in which the yarn is dyed before production of a woven or knit fabric.

Further, the bulked yarn from which the water-soluble yarn was extracted may be naturally dried. For improving the texture and air permeability of the bulked yarn, it is preferably dried by heating. The drying temperature can be properly selected according to the kind of fiber constituting the woven or knit fabric, or others, and is, for example, not lower than 50° C., preferably about 60 to 200° C., and more preferably about 70 to 150° C. (particularly preferably about 80 to 120° C.). The drying time is, for example, about 0.5 minutes to 24 hours, preferably about 1 minute to 10 hours, and more preferably about 3 minutes to 5 hours.

(Properties of Bulked Yarn)

The bulked yarn according to the present invention obtained by removing the water-soluble yarn by the above-described method (bulked single spun yarn obtained through bulking) is characterized by its small torque. Further, the bulked yarn according to the present invention is a raw yarn for producing a woven or knit fabric, and is required to have excellent warping properties and weaving and knitting properties. In order to improve the warping properties and weaving and knitting properties, normally, torque reduction is usually preferable, and to reduce the torque, heat setting (heating treatment such as steam setting) is effective. On the other hand, the bulked yarn according to the present invention may also be subjected to common heating treatment. As described above, the torque of the bulked yarn according to the present invention is small, so that it can be used as a raw yarn for producing a woven or knit fabric without being substantially subjected to heat treatment for reducing the torque.

Specifically, the torque index of the bulked yarn according to the present invention can be evaluated based on twisting occurring when a 100 cm-length yarn is hung down in a state where both ends of the yarn are fixed at a distance of 10 cm from each other in the direction perpendicular to the direction of gravitational force, and specifically, twisting does not occur in this test, or if twisting occurs, the average value of the distances from the uppermost end of the twisting section (uppermost end of the looped portion or coiled portion) to the first and second (left and right) fixed ends of the yarn is not less than 30 cm. That is, because the bulked yarn according to the present invention has such a low torque index as described above, the warping properties and weaving and knitting properties can be improved, productivity of a woven or knit fabric can be improved, and an excellent woven or knit fabric having no fiber that slips out can be produced.

Further, the average value of the distances from the uppermost end of the twisting section to the first and second (left and right) fixed ends of the yarn is preferably 35 cm or more and more preferably 40 cm or more (particularly preferably 45 cm or more), and a state with no twisting generated is most preferable. If the average value is excessively small, the torque is excessively high, so that the warping properties and weaving and knitting properties are deteriorated.

The B value expressed by the following equation of the bulked yarn according to the present invention is, for example, about 3 to 8, preferably about 3.1 to 7, and more preferably about 3.2 to 6 (particularly preferably about 3.3 to 5).

$$B=(N2/N1)\times(D2/D1)^2$$

In the equation, N1 is the number of twists of the single spun yarn, N2 is the number of twists of the composite twisted yarn, D1 is the average diameter of the single spun yarn, and D2 is the average diameter of the bulked single spun yarn.

The B value is an index indicating the relationship between the number of twists and bulkiness (voluminosity of yarn), and a small B value indicates properties with low voluminosity of the bulked yarn despite a small number of twists of the composite twisted yarn, and a large B value indicates properties with high voluminosity of the bulked yarn despite a large number of twists of the composite twisted yarn. In the present invention, by setting the B value within the above-described range, a bulked yarn with a small number of twists and appropriate voluminosity can be obtained.

Further, in the bulked yarn according to the present invention, the diameter of the bulked single spun yarn may be 1.2 times or more the diameter of the single spun yarn before being bulked, and is preferably about 1.3 to 2 times, and more preferably about 1.4 to 1.8 times the diameter of the single spun yarn before being bulked.

Typical examples of the bulked yarn for producing a woven or knit fabric according to the present invention include the following bulked yarns (I) and (IIa) to (IId).

(I) Bulked yarn (I) obtainable by providing a composite twisted yarn in which a single spun yarn and a water-soluble yarn are twisted together and dissolving the water-soluble yarn in water to remove the water-soluble yarn from the composite twisted yarn (IIa) Bulked yarn (IIa) obtainable by providing a yarn (a) in which two or more composite twisted yarns, each formed by twisting a single spun yarn a water-soluble yarn together, are doubled, and dissolving the water-soluble yarns in water to remove the water-soluble yarns from the yarn (a)

(IIb) Bulked yarn (IIb) obtainable by providing a yarn (b) in which two or more composite twisted yarns, each formed by twisting a single spun yarn a water-soluble yarn together, are twisted together, and dissolving the water-soluble yarns in water to remove the water-soluble yarns from the yarn (b)

(IIc) Bulked yarn (IIc) obtainable by providing a yarn (c) in which one or more composite twisted yarns, each formed by twisting a single spun yarn and a water-soluble yarn, and other yarn are doubled, and dissolving the water-soluble yarns in water to remove the water-soluble yarns from the yarn (c)

(IId) Bulked yarn (IId) obtainable) by providing a yarn (d) in which one or more composite twisted yarns, each formed by twisting a single spun yarn and a water-soluble yarn, and other yarn are twisted together, and dissolving the water-soluble yarns in water to remove the water-soluble yarns from the yarn (d)

In the present invention, not only in the bulked yarn (I) obtainable by dissolving and removing a water-soluble yarn in a hydrophilic solvent from a composite twisted yarn, but also in the bulked yarns (IIa) to (IId), each of the yarns (a) to (d) before removal of the water-soluble yarn by dissolution is formed by using a composite twisted yarn that has the above-described twisting properties and mass ratio, so that each of the bulked yarns from which the water-soluble yarn was removed by dissolution in a hydrophilic solvent is bulkier, better in texture, lightweight properties, heat-insulating properties, and water absorbency, and has better durability of these properties, sheds less fluff and has higher anti-pilling properties like the bulked yarn (I) than the single spun yarn before removal of the water-soluble yarn.

As the yarn (a) to be used for producing the bulked yarn (IIa), from the viewpoint of workability in extraction treatment, easiness of the removal by dissolution of the water-soluble yarn, and weaving and knitting properties of the bulked yarn (IIa) obtained by removing the water-soluble yarn by dissolution, etc., for example, a yarn obtained by doubling about two to four composite twisted yarns, preferably about two to three composite twisted yarns, and more preferably, about two composite twisted yarns, is preferably used.

As the yarn (b) to be used for producing the bulked yarn (IIb), from the viewpoint of workability in extraction treatment, easiness of the removal by dissolution of the water-soluble yarn, weaving and knitting properties of the obtained bulked yarn, and easiness of yarn twisting according to creel capacity, and others, for example, a yarn obtained by twisting about two to five composite twisted yarns, preferably about two to four composite twisted yarns, and more preferably about two or three composite twisted yarns, is preferably used.

The direction in which the two or more composite twisted yarns are doubled and twisted in the yarn (b) may be the same as the twisting direction of the composite twisted yarns. It is preferably the opposite direction to reduce the torque. From the viewpoint of workability in extraction treatment, easiness of the removal by dissolution of the water-soluble yarn, weaving and knitting properties of the obtained bulked yarn, stability of twisting, and texturing, and others, the number of twists of the yarn (b) is, for example, about 30 to 300 twists/m, preferably 40 to 250 twists/m, and more preferably, about 50 to 200 twists/m.

In the yarn (c) to be used for producing the bulked yarn (IIc), other yarn to be doubled to the composite twisted yarn includes, for example, according to use of the bulked yarn, various spun yarns other than the composite twisted yarn and filament yarns formed of natural fiber, synthetic fiber, semi-synthetic fiber, or others. These other yarns may be used singly or in combination of two or more kinds. Among these other yarns, for an increase in strength of the thread line and shape stability, a yarn (spun yarn or filament yarn) formed of a synthetic fiber such as a polyester-based resin or a polyamide-series resin is preferably used.

The fineness of other yarn is not particularly limited to a specific one. From the viewpoint of availability and texturing, the fineness is, for example, about 20 to 350 dtex and preferably about 20 to 180 dtex.

The yarn (c) is obtainable by doubling one or more composite twisted yarn and one or more other yarns, and may for example be a combination of one composite twisted yarn and one other yarn, a combination of one composite twisted yarn and two or more other yarns, and a combination of two or more composite twisted yarns and one or more other yarns. Among these, in view of workability in the extraction treatment, easiness of removal by dissolution of the water-soluble yarn, weaving and knitting properties of an obtained bulked yarn, and easiness of doubling, a yarn obtained by doubling one to three composite twisted yarns and one to three other yarns (other yarns formed of synthetic fiber such as polyester and polyamide), is preferably used.

In the yarn (d) to be used for producing the bulked yarn (IId), as other yarn to be twisted with the composite twisted yarn, the same spun yarn or filament yarn as in the yarn (c) can be used. The fineness of other yarn can also be selected in the same fineness range as that in the yarn (c).

The yarn (d) may be a yarn obtained by twisting one or more composite twisted yarns and one or more other yarns, and may for example be a combination of one composite twisted yarn and one other yarn, a combination of one composite twisted yarn and two or more other yarns, and a combination of two or more composite twisted yarns and one or more other yarns. Among these, from the viewpoint of workability in the extraction treatment, easiness of removal by dissolution of the water-soluble yarn, weaving and knitting properties of an obtained bulked yarn, and twisting easiness, the yarn obtained by twisting one to three composite twisted yarns and one to three other yarns (particularly other yarns formed of synthetic fiber such as polyester and polyamide) together is preferably used.

The direction in which the composite twisted yarn and other yarn are doubled and twisted in the yarn (d) is preferably the opposite direction as in the case of the yarn (b), and the number of twists can also be selected in the same range of the number of twists of the yarn (b).

The bulked yarn according to the present invention is a raw yarn for producing a woven or knit fabric, and preferably, it is prepared as a wound yarn wound into a skein shape or a tube shape, and used for producing a woven or knit fabric.

As described above, by sufficiently removing the water-soluble yarn constituting the composite twisted yarn, the bulked yarn according to the present invention is reduced in torque and improved in texture and lightweight properties, and on the surface of the single spun yarn, a very small amount of water-soluble yarn may remain within a range without generating torque nor spoiling the texture.

[Woven or Knit Fabric]

The woven or knit fabric according to the present invention includes the bulked yarn. The proportion of the bulked yarn in the woven or knit fabric can be adjusted according to the kind and use of the woven or knit fabric and properties required for the woven or knit fabric (e.g., texture, lightweight properties, heat-insulating properties, water absorbency, softness, and bulky feel), and for developing the properties of the bulked yarn, the proportion of the bulked yarn to be included is preferably 10 mass % or more relative to the total mass of the woven or knit fabric. Specifically, the proportion of the bulked yarn is about 20 mass % or more (for example, about 20 to 100 mass %), preferably about 30 mass % or more (for example, about 30 to 100 mass %), and more preferably about 40 mass % or more (for example, about 40 to 100 mass %)

relative to the total mass of the woven or knit fabric. Further, the composite twisted yarn may be used for a part of the woven or knit fabric in such a case where it is used for only the weft yarns of the woven fabric, and in this case, the proportion of the bulked yarn may for example be about 10 to 80 mass %, preferably about 20 to 70 mass %, and more preferably about 30 to 60 mass % relative to the total mass of the woven or knit fabric.

The kind of the woven or knit fabric according to the present invention is not especially limited as far as it includes the bulked yarn.

The woven fabric may include, for example, a plain weave (a plain textile), a twill weave (a twill textile), a sateen weave (a sateen textile), a Jacquard weave, a pile weave, a twill fabric, a satin fabric, a denim, and a gingham. The woven fabric contains the bulked yarn in either the warp yarns or weft yarns of the woven fabric. For example, the woven fabric may include, for example, a woven fabric using the bulked yarn as warp yarns and weft yarns, a woven fabric using the bulked yarn as warp yarns or weft yarns, and a woven fabric using the bulked yarn as a part of the warp yarns and/or a part of the weft yarns.

The knit fabric may include, for example, a flat knit fabric, a warp knit fabric, a circular knit fabric, and a pile knitted fabric. Further, the knit fabric may be a machine-knitted fabric, a crocheted fabric, a needle-knitted fabric, an afghan knitted fabric and other fabrics. By using the bulked yarn according to the present invention, fine knitting is possible without causing welt skew even when a single-knit fabric or the like is knitted.

Among these woven or knit fabrics, the pile woven or knit fabric such as a pile woven fabric or a pile knitted fabric preferably contains the bulked yarn according to the present invention as a pile yarn. By producing a pile woven or knit fabric by using the bulked yarn of the present invention as a pile yarn, a pile woven or knit fabric (e.g., towel cloth and wiping cloth) that has an airy and excellent texture, and is excellent in lightweight properties, air permeability, water absorbency, and heat-insulating properties can be produced.

The woven or knit fabric according to the present invention can be produced by a common method, and the obtained woven or knit fabric may be subjected to scouring and heat treatment if necessary. It is preferable to avoid treatments (for example, excessive pulling and calendaring) that deteriorate the properties such as bulkiness, texture, lightweight properties, air permeability, heat-insulating properties, and water absorbency.

The woven or knit fabric according to the present invention may contain an additive such as a stabilizer (e.g., a heat stabilizer, an ultraviolet absorber, a light stabilizer, and an antioxidant), a fine particle, a colorant, an antistatic agent, a flame retardant, a plasticizer, a lubricant, or a crystallization retardant, if necessary. These additives may be used singly or in combination of two or more kinds. These additives may be contained either in the respective yarns (e.g., bulked yarns) constituting the woven or knit fabric or in the woven or knit fabric.

The woven or knit fabric according to the present invention is lightweight but voluminous, soft with an excellent touch, and excellent in air permeability, heat-insulating properties, and water absorbency, and has excellent durability of these properties, sheds no fluff, and has excellent anti-pilling properties, so that by taking advantage of these properties, the woven or knit fabric can be effectively used for sportswear, underwear, a foundation garment, jeans, outerwear, and other clothes, medical uses such as elastic wrap, vehicle interior materials, belt conveyor fabric, and other industrial materials.

EXAMPLES

Hereinafter, the following examples are intended to describe this invention in further detail and should by no means be interpreted as defining the scope of the invention.

[1] Production of Processed Spun Yarn

In the following Examples and Comparative Examples, a ratio of an average diameter of a processed spun yarn (bulked spun yarn or less-bulked processed spun yarn) obtained by removing a water-soluble yarn by dissolution in water from a composite twisted yarn relative to an average diameter of a spun yarn used for producing the composite twisted yarn, and the B value, were obtained by the following method, and the texture was evaluated by the following method.

Further, as evaluation of weaving or knitting properties, a torque index of a raw yarn for producing a woven or knit fabric was measured by the following method.

(1) Ratio of Average Diameter of Processed Spun Yarn Relative to Average Diameter of Spun Yarn (i) A spun yarn (original single spun yarn) used for producing the composite twisted yarn and a processed spun yarn (bulked spun yarn) from which the water-soluble yarn was removed by dissolution in water were arranged in parallel at a distance, and photographed with an electron microscope (25-fold magnification). In FIG. 1, the upper yarn is an electron micrograph of the bulked yarn in Example 1, and the lower yarn is an electron micrograph of the single spun yarn used for producing the composite twisted yarn in the Example.

(ii) Diameters of both of the spun yarn and processed spun yarn were measured with a ruler at five positions of 5 mm (Position 1), 25 mm (Position 2), 45 mm (Position 3), 65 mm (Position 4), and 85 mm (Position 5) from the left end of the photograph obtained in (i) above (provided that fluff portions projecting to the outside were not included in the diameters), and by averaging the five measured values, an average diameter of the spun yarn and an average diameter of the processed spun yarn were obtained, and by dividing the average diameter of the processed spun yarn by the average diameter of the spun yarn, an average diameter ratio of the processed spun yarn relative to the spun yarn was obtained.

(2) B Value of Processed Spun Yarn

By a method in accordance with JIS L1095, the number of twists (N1) of the original single spun yarn and the number of twists (N2) of the composite twisted yarn are measured. From the measured number of twists and the average diameter (D1) of the original single spun yarn and the average diameter (D2) of the bulked single spun yarn obtained in (i) above, the B value was calculated based on the following equation.

$$B=(N2/N1)\times(D2/D1)^2$$

In the equation, N1 is the number of twists of the single spun yarn, N2 is the number of twists of the composite twisted yarn, D1 is an average diameter of the single spun yarn, and D2 is an average diameter of the bulked single spun yarn.

(3) Evaluation of Texture of Processed Spun Yarn:

The texture of the spun yarn (original spun yarn) before removal by dissolution of the water-soluble yarn used for producing the composite twisted yarn was graded 3 (as standard). Based on the evaluation criteria shown in Table 1, five panelists evaluated the texture of the processed spun yarn, and an average was calculated.

TABLE 1

(Evaluation criteria for texture of processed spun yarn)

| Grades | Evaluation contents |
|---|---|
| 5 | Much bulkier, very soft, and extremely excellent texture as compared with original spun yarn. |
| 4 | Considerably bulky, soft, and good texture as compared with original spun yarn. |
| 3 | Same appearance (tightness) and same touch as original spun yarn (standard). |
| 2 | Slightly tighter and slightly harder than original spun yarn. |
| 1 | Very tight and considerably harder as compared with original spun yarn. |

(4) Torque Index of Raw Yarn

The raw yarn to be used for producing a woven or knit fabric was cut to be 100 cm long, and hung down in a state where both ends were fixed at a distance of 10 cm from each other in the direction perpendicular to the direction of gravitational force. When the yarn has a torque, it twists (coils), so that when the twisting motion (coiling motion) stopped, the distances (cm) from the uppermost end of the twisting section (entwining portion) to the first and second (left and right) ends of the yarn were measured, and an average value of both was defined as a torque index. If twisting does not occur, "no torque" was indicated.

Examples 1 to 5 and Comparative Examples 1 and 2

(1) (i) As a single spun yarn, a 20-count single spun yarn ("TS20 single yarn" manufactured by Tsuzuki Spinning Co., Ltd.) made of 100% cotton fiber and having the number of twists of 600 twists/m (Z twist) was prepared. This single spun yarn has the number of twists T=15.24 per 2.54 cm, and its count S=20, so that the twist coefficient K obtained based on the equation: $K=(T/\sqrt{S})$ is $15.24/\sqrt{20}=15.24/4.47=3.24$.

(ii) As a water-soluble yarn, a polyvinyl alcohol multifilament yarn ("Water-soluble vinylon" manufactured by KURARAY CO., LTD., that is a yarn soluble in water at 80° C., 38 dtex/12 filaments) was prepared.

(2) One single spun yarn prepared in (i) of (1) above and one water-soluble yarn prepared in (ii) of (1) above were supplied to a double twister ("36M" manufactured by Murata Machinery, Ltd.) and twisted together in the S direction to the number of twists (the number of final twists) shown in Table 2 to produce composite twisted yarns.

(3) From the respective composite twisted yarns obtained in (2) described above, yarns with a predetermined length (1 m) were cut and used as sample yarns, and each sample yarn was separated into two yarns of the single spun yarn and the water-soluble yarn by untwisting the final twists, and the masses of the separated yarns were respectively measured, and from the measurement results, the proportions of the yarns in each composite twisted yarn were obtained, and as a result, each of the composite twisted yarns was composed of 88 mass % of the single spun yarn and 12 mass % of the water-soluble yarn.

(4) After the respective composite twisted yarns obtained in (2) were wound up around dyeing bobbins, they were compressed from above to have a fiber density of 0.3 g/cm$^3$, and the wound up composite twisted yarns were put into a pot of a dyeing machine and treated in hot water at 95° C. for 15 minutes to remove the water-soluble yarns from the composite twisted yarns by dissolution, and then thoroughly washed with water at 50° C., dried with hot air at 90° C. for 90 minutes to produce processed spun yarns.

(5) The results of measurement or evaluation of ratios of average diameters of the processed spun yarns relative to average diameters of the single spun yarns used to produce the composite twisted yarns, B values, and textures of the processed spun yarns obtained in (4) described above are shown in Table 3. Further, the results of measurement of torque indexes of the processed spun yarns of Examples 1 to 5 are shown in Table 3.

However, in Comparative Example 1, raw cotton (cotton fiber) came off (or slipped from) the processed spun yarn obtained by removing the water-soluble yarn included in the composite twisted yarn by dissolution in water, so that the processed spun yarn could not be used for producing a woven or knit fabric.

In Comparative Example 2, the number of final twists for producing the composite twisted yarn was large and the torque was excessively strong, so that processability at the time of production of the composite twisted yarn was poor, and the composite twisted yarn could not be smoothly produced.

An electron micrograph (25-fold magnification) of the bulked spun yarn obtained in Example 1 and the original single spun yarn ("TS20 single yarn" manufactured by Tsuzuki Spinning Co., Ltd.) used for production of the bulked spun yarn is shown in FIG. 1. In FIG. 1, the upper yarn is the bulked spun yarn, and the lower yarn is the original single spun yarn ("TS20 single yarn" manufactured by Tsuzuki Spinning Co., Ltd.).

Comparative Example 3

(1) (i) Two 40-count spun yarns ("TS40 single yarn" manufactured by Tsuzuki Spinning Co., Ltd.) made of 100% cotton fiber and having the number of twists of 800 twists/m (Z twist) were supplied to a double twister ("36M" manufactured by Murata Machinery, Ltd.) and twisted at the number of twists of 600 twists/m (S twist) to produce a two ply yarn.

(ii) As a water-soluble yarn, a polyvinyl alcohol multifilament yarn ("Water-soluble vinylon" manufactured by KURARAY CO., LTD., that is a yarn soluble in water at 80° C., 56 dtex/12 filaments) was prepared.

(2) The two ply yarn (spun yarn) produced in (i) of (1) described above and the water-soluble yarn prepared in (ii) of (1) described above were supplied to a double twister ("36M" manufactured by Murata Machinery, Ltd.) and twisted so that the number of twists (the number of final twists) reached 1000 twists/m (Z twist) to produce a composite twisted yarn [the ratio of the number of twists N2 of the composite twisted yarn to the number of twists N1 of the spun yarn (N2/N1)=about 1.7].

(3) A yarn with a predetermined length (1 m) was cut from the composite twisted yarn obtained in (2) described above and used as a sample yarn, the final twists of this sample yarn were untwisted to separate the yarn into two kinds of yarns of the spun yarn (two ply yarn) and the water-soluble yarn, the masses of the separated yarns were respectively measured, and from the measurement results, the proportions of these yarns in the composite twisted yarn were obtained, and as a result, the composite twisted yarn was composed of 85 mass % of the spun yarn (two ply yarn) and 15 mass % of the water-soluble yarn.

(4) The composite twisted yarn obtained in (2) described above was wound up around a dyeing bobbin and then compressed from above to have a fiber density of 0.3 g/cm$^3$, the wound up composite twisted yarn was put into a pot of a dyeing machine and treated in hot water at 95° C. for 15 minutes to remove the water-soluble yarn in the composite twisted yarn by dissolution, and then thoroughly washed with water at 50° C., and then dried with hot air at 90° C. for 90 minutes to obtain a processed spun yarn.

(5) The results of measurement or evaluation of the ratio of the average diameter of the processed spun yarn obtained in (4) above relative to the average diameter of the spun yarn (two ply yarn) used to produce the composite twisted yarn, the B value and texture of the processed spun yarn are shown in Table 3.

Comparative Example 4

(1) (i) A 40-count single spun yarn (single spun yarn) ("TS40 single yarn" manufactured by Tsuzuki Spinning Co., Ltd.) made of 100% cotton fiber and having the number of twists of 800 twists/m (Z twist) was prepared.

(ii) As a water-soluble yarn, a polyvinyl alcohol multifilament yarn ("Water-soluble vinylon" manufactured by KURARAY CO., LTD., that is a yarn soluble in water at 80° C., 56 dtex/12 filaments) was prepared.

(2) Two 40-count spun yarns (single spun yarns) made of 100% cotton fiber prepared in (i) of (1) described above and one water-soluble yarn prepared in (ii) of (1) described above were supplied to a double twister ("36M" manufactured by Murata Machinery, Ltd.) and twisted so that the number of twists (the number of final twists) reached 1200 twists/m (S twist) to produce a composite twisted yarn [the ratio of the number of twists N2 of the composite twisted yarn relative to the number of twists N1 of the spun yarn (N2/N1)=1.5].

(3) A yarn with a predetermined length (1 m) was cut from the composite twisted yarn obtained in (2) described above and used as a sample yarn, the final twists of this sample yarn were untwisted to separate the yarn into two kinds of yarns of the spun yarn (two ply yarn) and the water-soluble yarn, the masses of the separated yarns were respectively measured, and from the measurement results, the proportions of these yarns in the composite twisted yarn were respectively obtained, and as a result, the composite twisted yarn was composed of 84 mass % of the spun yarn (two ply yarn) and 16 mass % of the water-soluble yarn.

(4) The composite twisted yarn obtained in (2) described above was wound up around a dyeing bobbin and then compressed from above to have a fiber density of 0.3 g/cm$^3$, the wound up composite twisted yarn was put into a pot of a dyeing machine and treated in hot water at 95° C. for 15 minutes to remove the water-soluble yarn in the composite twisted yarn by dissolution, and then thoroughly washed with water at 50° C., and then dried with hot air at 90° C. for 90 minutes to obtain a processed spun yarn.

(5) The results of evaluation on the average diameter ratio, B value, and texture of the processed spun yarn obtained in (4) above are shown in Table 3.

Comparative Example 5

(1) (i) A 5-count spun yarn (single spun yarn) made of 100% cotton fiber and having the number of twists of 260 twists/m (Z twist) (manufactured by MIMASU Co., Ltd.) was prepared.

(ii) As a water-soluble yarn, a polyvinyl alcohol multifilament yarn ("Water-soluble vinylon" manufactured by KURARAY CO., LTD., that is a yarn soluble in hot water at 80° C., 17 dtex/6 filaments) was prepared.

(2) The single spun yarn prepared in (i) of (1) described above and the water-soluble yarn prepared in (ii) of (1) described above were supplied to a double twister ("36M" manufactured by Murata Machinery, Ltd.) and twisted so that the number of twists (the number of final twists) reached 520 twists/m (S twist) to produce a composite twisted yarn [the ratio of the number of twists N2 of the composite twisted yarn relative to the number of twists N1 of the spun yarn (N2/N1)=2.0].

(3) A yarn with a predetermined length (1 m) was cut from the composite twisted yarn obtained in (2) described above and used as a sample yarn, the final twists of this sample yarn were untwisted to separate the yarn into two kinds of yarns of the single spun yarn and the water-soluble yarn, the masses of the separated yarns were respectively measured, and from the measurement results, the proportions of these yarns in the composite twisted yarn were respectively obtained, and as a result, the composite twisted yarn was composed of 98.5 mass % of the single spun yarn and 1.5 mass % of the water-soluble yarn.

(4) The composite twisted yarn obtained in (2) described above was wound up around a dyeing bobbin and then compressed from above to have a fiber density of 0.3 g/cm$^3$, the wound up composite twisted yarn was put into a pot of a dyeing machine and treated in hot water at 95° C. for 15 minutes to remove the water-soluble yarn in the composite twisted yarn by dissolution, and then thoroughly washed with water at 50° C., and then dried with hot air at 90° C. for 90 minutes to obtain a processed spun yarn.

(5) Results of measurement or evaluation of the ratio of the average diameter of the processed spun yarn obtained in (4) described above relative to the average diameter of the spun yarn (single spun yarn) used to produce the composite twisted yarn, the B value and texture of the processed spun yarn, are shown in Table 3.

Comparative Example 6

(1) (i) A 120-count spun yarn (single spun yarn) made of 100% cotton fiber and having the number of twists of 1500 twists/m (Z twist) ("Royal 120" manufactured by Royal Textile Mills Ltd. (India)) was prepared.

(ii) As a water-soluble yarn, a polyvinyl alcohol multifilament yarn ("Water-soluble vinylon" manufactured by KURARAY CO., LTD., that is a yarn soluble in hot water at 80° C., 56 dtex/12 filaments) was prepared.

(2) The single spun yarn prepared in (i) of (1) described above and four water-soluble yarns prepared in (ii) of (1) described above were supplied to a double twister ("36M" manufactured by Murata Machinery, Ltd.) and twisted so that the number of twists (the number of final twists) reached 2500 twists/m (S twist) to produce a composite twisted yarn [the ratio of the number of twists N2 of the composite twisted yarn relative to the number of twists N1 of the spun yarn (N2/N1)=about 1.7].

(3) A yarn with a predetermined length (1 m) was cut from the composite twisted yarn obtained in (2) described above and used as a sample yarn, the final twists of this sample yarn were untwisted to separate the yarn into two kinds of yarns of the single spun yarn and the water-soluble yarn, the masses of the separated yarns were respectively measured, and from the measurement results, the proportions of these yarns in the composite twisted yarn were respectively obtained, and as a result, the composite twisted yarn was composed of 17 mass % of the single spun yarn and 83 mass % of the water-soluble yarn.

(4) The composite twisted yarn obtained in (2) described above was wound up around a dyeing bobbin and then compressed from above to have a fiber density of 0.3 g/cm$^3$, the wound up composite twisted yarn was put into a pot of a dyeing machine and treated in hot water at 95° C. for 15 minutes to remove the water-soluble yarn in the composite twisted yarn by dissolution, and then thoroughly washed with water at 50° C., and then dried with hot air at 90° C. for 90 minutes to obtain a processed spun yarn, however, the winding of the obtained processed spun yarn falls apart and it was difficult to produce a woven or knit fabric.

TABLE 2

(Properties of composite twisted yarn)

| | Spun yarn | | | | Number of | | |
|---|---|---|---|---|---|---|---|
| | Kind | Number of twists (twisting direction) (twists/m) | Number of yarns (number) | Water-soluble yarn | twists of composite twisted yarn (twisting direction) | Ratio of number of twists (N2/N1) | Spun yarn/ water-soluble yarn (mass ratio) |
| Comparative Example 1 | Single yarn | 600 (Z) | 1 | PVA yarn | 600 (S) | 1.0 | 88/12 |
| Example 1 | Single yarn | 600 (Z) | 1 | PVA yarn | 780 (S) | 1.3 | 88/12 |
| Example 2 | Single yarn | 600 (Z) | 1 | PVA yarn | 900 (S) | 1.5 | 88/12 |
| Example 3 | Single yarn | 600 (Z) | 1 | PVA yarn | 1200 (S) | 2.0 | 88/12 |
| Example 4 | Single yarn | 600 (Z) | 1 | PVA yarn | 1500 (S) | 2.5 | 88/12 |
| Example 5 | Single yarn | 600 (Z) | 1 | PVA yarn | 1800 (S) | 3.0 | 88/12 |
| Comparative Example 2 | Single yarn | 600 (Z) | 1 | PVA yarn | 2100 (S) | 3.5 | 88/12 |
| Comparative Example 3 | Two ply yarn | 600 (S) | 1 | PVA yarn | 1000 (Z) | 1.7 | 85/15 |
| Comparative Example 4 | Single yarn | 800 (Z) | 2 | PVA yarn | 1200 (S) | 1.5 | 84/16 |
| Comparative Example 5 | Single yarn | 260 (Z) | 1 | PVA yarn | 520 (S) | 2.0 | 98.5/1.5 |
| Comparative Example 6 | Single yarn | 1500 (Z) | 1 | PVA yarn | 2500 (S) | 1.7 | 17/83 |

TABLE 3

(Evaluation of processed spun yarn)

| | Symbol | Diameter ratio (after removal/ before removal) | B value | Texture | Torque index (cm) |
|---|---|---|---|---|---|
| Comparative Example 1 | F1 | — | — | — | — |
| Example 1 | E1 | 1.6 | 3.33 | 4.6 | Nothing |
| Example 2 | E2 | 1.5 | 3.38 | 5.0 | Nothing |
| Example 3 | E3 | 1.4 | 3.92 | 5.0 | 45 |
| Example 4 | E4 | 1.3 | 4.23 | 4.6 | 42 |
| Example 5 | E5 | 1.2 | 4.32 | 4.2 | 38 |
| Comparative Example 2 | F2 | 1.0 | 3.50 | 3.0 | — |
| Comparative Example 3 | F3 | 1.1 | 2.06 | 3.2 | — |
| Comparative Example 4 | F4 | 1.1 | 1.82 | 3.2 | — |
| Comparative Example 5 | F5 | 1.1 | 2.42 | 3.0 | — |
| Comparative Example 6 | F6 | 1.5 | 3.83 | 4.5 | — |

As apparent from Table 3, in each of Examples 1 to 5, a processed spun yarn was obtained by removing a water-soluble yarn by dissolution in water from the composite twisted yarn obtained by twisting a single spun yarn and the water-soluble yarn in a direction opposite to the twisting direction of the single spun yarn so that the number of twists of the composite twisted yarn is within the range of 1.3 to 3 times the number of twists of the single spun yarn, and the proportion of the single spun yarn was within the range of 98 to 20 mass % and the proportion of the water-soluble yarn was within the range of 2 to 80 mass %, and accordingly, the bulked spun yarn that was bulkier (bulked) and softer, and had a better texture than the original single spun yarn was obtained.

Further, the processed spun yarns of Examples 1 to 5 had B values in the appropriate range, and have superior texture. Further, the processed spun yarns of Examples 1 to 5 had small torques and excellent weaving and knitting properties.

On the other hand, in Comparative Example 1, the number of final twists (A) of the composite twisted yarn was 1.0 times the number of twists (the number of first twists) (B) of the single spun yarn, so that raw cotton (cotton fiber) fell of (or slipped from) the obtained processed spun yarn, and the processed spun yarn could not be used for producing a woven or knit fabric.

In Comparative Example 2, the number of final twists (A) of the composite twisted yarn was 3.5 times the number of twists (the number of first twists) of the single spun yarn. Thus, the number of final twists was large and the torque became excessively strong, so that the processability in production of the composite twisted yarn was poor, and the composite twisted yarn could not be smoothly produced.

In Comparative Example 3, a composite twisted yarn obtained by twisting a two ply spun yarn and a water-soluble yarn was used, and in Comparative Example 4, a composite twisted yarn obtained by twisting two spun yarns (single spun yarns) and a water-soluble yarn was used, so that the processed spun yarns obtained by removing the water-soluble yarns in the composite twisted yarns by dissolution in water were less bulky, less soft, and inferior in texture than the original spun yarns.

In Comparative Example 5, the proportion of the water-soluble yarn in the composite twisted yarn was less than 2 mass %, so that the processed spun yarn obtained by removing the water-soluble yarn in the composite twisted yarn by dissolution in water was less bulky, less soft, and inferior in texture than the original spun yarn.

In Comparative Example 6, the proportion of the single spun yarn in the composite twisted yarn was less than 20 mass %, so that when the water-soluble yarn in the composite twisted yarn was removed by dissolution in water, the winding thereof fell apart and it was difficult to produce a woven or knit fabric.

[2] Production of Woven or Knit Fabric

In the following Examples, Comparative Examples, and Reference Examples, the textures, degree of bulkiness, pilling, water absorbencies, drying performance, and fluff-shedding properties of the woven or knit fabrics obtained by weaving or knitting were measured or evaluated by the following methods.

(1) Texture of Woven or Knit Fabric

The same spun yarn (original spun yarn before bulking) as that used for obtaining the bulked spun yarn was woven or knitted into a predetermined conformation (or construction) by a predetermined machine to give a woven or knit fabric. The texture of the resulting woven or knitted fabric was graded 3 (as standard). Based on the evaluation criteria shown in Table 4 below, five panelists made evaluation, and an average was calculated.

TABLE 4

(Evaluation criteria for texture of woven or knit fabric)

| Grades | Evaluation contents |
|---|---|
| 5 | Much bulkier, much softer, and much extremely excellent touch than the standard woven or knit fabric. |
| 4 | Considerably bulky, considerably soft, and good touch as compared with the standard woven or knit fabric. |
| 3 | Same appearance (bulkiness or tightness) and same touch as those of woven or knit fabric (standard) produced by using a spun yarn that is not bulked. |
| 2 | Slightly tighter appearance and slightly harder touch than those of the standard woven or knit fabric. |
| 1 | Very tight appearance and considerably harder touch as compared with the standard woven or knit fabric. |

(2) Degree of Bulkiness of Woven or Knit Fabric

Based on a thickness ($D_0$) (mm) of a layer of eight pieces of woven and knit fabric obtained by weaving or knitting the spun yarn (original spun yarn before bulking) used for obtaining bulked spun yarns so as to have the same conformation by using a circular knitting machine ("LIL4" manufactured by Precision Fukuhara Works, Ltd.) for interlock knitted fabric, a pile knitting machine ("PLII" manufactured by Precision Fukuhara Works, Ltd.) for pile knitted fabric, or an ultrahigh-speed rapier loom ("Beat MAX 1001" manufactured by ISHIKAWA SEISAKUSHO, LTD.), and a thickness (D) (mm) of a layer of eight pieces of woven or knit fabric obtained according to the Example, Comparative Example, or Reference Example, the degree of bulkiness of woven or knit fabric was calculated by the following numerical equation.

$$\text{Degree of bulkiness (\%) of woven or knit fabric}=(D/D_0)\times 100$$

(3) Pilling

Measurement was performed according to the JIS L1076-A method.

(4) Water Absorbency of Woven or Knit Fabric

Measurement was performed according to the precipitation method provided in JIS L1907. The shorter the precipitation time takes, the higher the water absorbency is provided.

(5) Drying Performance of Woven or Knit Fabric

Test pieces were prepared by cutting woven or knit fabrics obtained in the following Examples, Comparative Examples, and Reference Examples into a size of 30 mm longitudinally ×30 mm laterally, and about 0.3 ml of water was dropped onto the center of the test pieces [mass $W_0$ (mg)] and the masses ($W_1$) (mg) of the test pieces at this time were measured, and then immediately, put into a constant-temperature and constant-humidity chamber in which the temperature was 20° C. and the humidity was 65%, and left for 60 minutes. Further, the test pieces were taken out from the constant-temperature and constant-humidity chamber, the masses ($W_2$) (mg) were measured, and the amounts of moisture (%) remaining in the test pieces were calculated according to the following equation and used as indexes of drying performance. The smaller the amount of residual moisture (%) is, the more easily the woven or knit fabric is dried.

$$\text{Amount of residual moisture (\%)}=\{(W_2-W_0)/(W_1-W_0)\}\times 100$$

(6) Fluff-Shedding Properties of Woven or Knit Fabric

About 1000 g of a woven or knit fabric was left in an atmosphere with a temperature of 20° C. and a humidity of 65% for 24 hours, and the mass (Wa) (g) of the woven or knit fabric after being left for 24 hours was measured, and then the woven or knit fabric was washed three times and dried according to the method of JIS L0217 103, the dried woven or knit fabric was left in an atmosphere with a temperature of 20° C. and a humidity of 65% for 24 hours, the mass (Wb) (g) of the woven or knit fabric after being left for 24 hours was measured, and the fluff-shedding ratio (mass decrease ratio after washing) (%) was calculated based on the following equation and used as an index of fluff-shedding properties. The smaller the mass decrease ratio is, the less fluffs shed.

$$\text{Fluff-shedding ratio (mass decrease ratio after washing) (\%)}=\{(Wa-Wb)/(Wa)\}\times 100$$

Examples 6 to 8

An interlock knitted fabric was knitted with a 14G×30-inch circular knitting machine by using singly the processed spun yarn (E2), (E3), or (E4) obtained in Examples 2 to 4, and the obtained interlock knitted fabric was scoured in a bath by a continuous scouring machine at 95° C. and dried by a hot air dryer at 150° C. Results of evaluation or measurement of the texture, degree of bulkiness, pilling, water absorbency, and drying performance of the obtained interlock knitted fabric are shown in Table 5.

Examples 9 and 10

The processed spun yarn (E2) obtained in Example 2 and a 20-count single spun yarn ("TS20 single yarn" manufactured by Tsuzuki Spinning Co., Ltd.) made of 100% cotton fiber and having the number of twists of 600 twists/m (Z twist) were knitted at a ratio of 1/1 (the processed spun yarn (E2)/the 20-count single spun yarn) [proportion of the processed spun yarn (E2): 48 mass %] in Example 9 and at a ratio of 1/3 (the processed spun yarn (E2)/the 20-count single spun yarn) [proportion of the processed spun yarn (E2): 24 mass %] in Example 10 with a 14G×30-inch circular knitting machine to obtain interlock knitted fabrics, and the obtained interlock knitted fabrics were scoured in a bath by a continuous scouring machine at 95° C. and dried by a hot air dryer at 150° C. Results of evaluation or measurement of the texture, degree of bulkiness, pilling, water absorbency, and drying performance of the obtained interlock knitted fabrics are shown in Table 5.

Comparative Example 7

By using only a 20-count single spun yarn ("TS20 single yarn" manufactured by Tsuzuki Spinning Co., Ltd.) made of 100% cotton fiber and having the number of twists of 600 twists/m (Z twist), an interlock knitted fabric was knitted with a 14G×30-inch circular knitting machine, and the obtained interlock knitted fabric was scoured in a bath by a continuous scouring machine at 95° C. and dried by a hot air dryer at 150° C. Results of evaluation or measurement of the texture, degree of bulkiness, pilling, water absorbency, and drying performance of the obtained interlock knitted fabric are shown in Table 5.

Reference Example 1

(1) By using singly a composite twisted yarn obtained in (2) of Example 2 [a composite twisted yarn produced by supplying one 20-count single spun yarn ("TS20 single yarn" manufactured by Tsuzuki Spinning Co., Ltd.) made of 100% cotton fiber and having the number of twists of 600 twists/m) (Z twist) and one polyvinyl alcohol multifilament yarn ("Water-soluble vinylon" manufactured by KURARAY CO., LTD., soluble in water at 80° C., 38 dtex/12 filaments) to a double twister ("36M" manufactured by Murata Machinery, Ltd.) and twisting these yarns in the S direction at the number of twists (the number of final twists) of 900 twists/m], an interlock knitted fabric was knitted with a 14G×30-inch circular knitting machine, and accordingly, an interlock knitted fabric was produced from the composite twisted yarn.

(2) The interlock knitted fabric obtained in (1) above was immersed in hot water at 95° C. for 30 minutes to remove the water-soluble yarn (polyvinyl alcohol multifilament yarn) in the composite twisted yarn forming the knitted fabric by dissolution, and then the knitted fabric was taken out from water and dried at 150° C. Results of evaluation or measurement of the texture, degree of bulkiness, pilling, water absorbency, and drying performance of the obtained interlock knitted fabric are shown in Table 5.

Reference Example 2

(1) A torque index of the composite twisted yarn obtained in (2) of Example 3 [a composite twisted yarn produced by supplying one 20-count single spun yarn ("TS20 single yarn" manufactured by Tsuzuki Spinning Co., Ltd.) made of 100% cotton fiber and having the number of twists of 600 twists/m (Z twist) and one polyvinyl alcohol multifilament yarn ("Water-soluble vinylon" manufactured by KURARAY CO., LTD., soluble in water at 80° C., 38 dtex/12 filaments) to a double twister ("36M" manufactured by Murata Machinery, Ltd.) and twisting these yarns in the S direction at the number of twists (the number of final twist) of 1200 twists/m], was measured, and as a result, the torque index was 8.3 cm, and the torque was excessively strong and knitting properties were extremely poor. Therefore, after applying vacuum steam setting at 98° C., the torque index of the steam-set composite twisted yarn was measured again, and as a result, the torque index was 27.5 cm.

(2) By using singly the steam-set composite twisted yarn, an interlock knitted fabric was knitted with a 14G×30-inch circular knitting machine, and accordingly, an interlock knitted fabric composed of the composite twisted yarn was produced, and the fabric could be knitted at 13 circles/minute. However, when the circular knitting machine stopped due to yarn breakage, a torque was generated in the broken yarn due to the tension and the broken yarn curled, and it was hard to restart the circular knitting machine. On the other hand, in Example 7 using the processed spun yarn of Example 3, knitting at 18 circles/minute that is higher than in Reference Example 2 was realized, so that even if the circular knitting machine stops due to yarn breakage, it could be easily restarted. This result shows that the composite twisted yarn described in Patent Document 3 (Japanese Patent No. 4393357) is not excellent in weaving and knitting properties as a raw yarn for producing a woven or knit fabric.

(3) The interlock knitted fabric obtained in (2) above was immersed in hot water at 95° C. for 30 minutes to remove the water-soluble yarn (polyvinyl alcohol multifilament yarn) in the composite twisted yarn forming the knitted fabric by dissolution, and then the knitted fabric was taken out from water and dried at 150° C. Results of evaluation or measurement of the texture, degree of bulkiness, pilling, water absorbency, and drying performance of the obtained interlock knitted fabric are shown in Table 5.

Further, when the yarn was unraveled from the obtained knitted fabric and the processed spun yarn was observed, an average diameter ratio of the processed single spun yarn to the original single spun yarn used for producing the composite twisted yarn was 1.3, and the texture was evaluated as 4.0. On the other hand, when the yarn was unraveled from the knitted fabric obtained in Example 7 and the processed spun yarn was observed, an average diameter ratio of the processed single spun yarn to the original single spun yarn used for producing the composite twisted yarn was 1.5, and the texture was evaluated as 4.8. These results indicate the removal of the water-soluble yarn by dissolution in the state of the composite twisted yarn probably allows the spun yarn to be bulked smoothly and thus the resulting yarn shows a higher degree of bulkiness compared with the yarn obtained by dissolving and removing the water-soluble yarn in the state of the woven or knit fabric.

The results of measurements of the torque indexes before removal by dissolution of the water-soluble yarns in Comparative Examples 1 to 6 are 13 cm in Comparative Example 1, 7 cm in Comparative Example 2, 13 cm in Comparative Example 3, 9 cm in Comparative Example 4, 8 cm in Comparative Example 5, and 15 cm in Comparative Example 6, and each of these show strong torques.

TABLE 5

| | Details of knitted fabric | | | Physical properties of knitted fabric | | | | |
|---|---|---|---|---|---|---|---|---|
| | Kind | Kind of yarn | Removal of water-soluble yarn by dissolution | Texture | Degree of bulkiness | Pilling | Water absorbency | Drying performance |
| Example 6 | Interlock knitted fabric | E2: 100% | In the state of yarn | 5.0 | 180% | 3.5 | <1 sec. | 14% |
| Example 7 | Interlock knitted fabric | E3: 100% | In the state of yarn | 4.8 | 165% | 4 | <1 sec. | 14% |

TABLE 5-continued

| | Details of knitted fabric | | | Physical properties of knitted fabric | | | | |
|---|---|---|---|---|---|---|---|---|
| | Kind | Kind of yarn | Removal of water-soluble yarn by dissolution | Texture | Degree of bulkiness | Pilling | Water absorbency | Drying performance |
| Example 8 | Interlock knitted fabric | E4: 100% | In the state of yarn | 4.6 | 150% | 4.5 | <1 sec. | 16% |
| Example 9 | Interlock knitted fabric | E2: 48% 20-Count cotton single yarn: 52% | In the state of yarn | 4.6 | 155% | 4 | 2 sec. | 18% |
| Example 10 | Interlock knitted fabric | E2: 24% 20-Count cotton single yarn: 76% | In the state of yarn | 4.4 | 130% | 4 | 3 sec. | 22% |
| Comparative Example 7 | Interlock knitted fabric | 20-Count cotton single yarn: 100% | — | 3 (Standard) | 100% (Standard) | 4 | 5 sec. | 28% |
| Reference Example 1 | Interlock knitted fabric | Composite twisted yarn obtained in (2) of Example 2: 100% | After knitting | 4.4 | 130% | 4 | 5 sec. | 17% |
| Reference Example 2 | Interlock knitted fabric | Composite twisted yarn obtained in (2) of Example 3: 100% | After knitting | 4.2 | 130% | 4 | 5 sec. | 18% |

As apparent from Table 5, the interlock knitted fabrics of Examples 6 to 8 produced from the processed spun yarns (bulked spun yarns) alone obtained in Examples 2 to 4 have further more excellent texture, larger bulking degree, and further more excellent water absorbency and drying performance than the knitted fabric of Reference Example 1 or Reference Example 2 obtained by producing an interlock knitted fabric from the composite twisted yarn alone obtained in (2) of Example 2 or Example 3 and then dissolving and removing the water-soluble yarn of the knitted fabric in water.

The interlock knitted fabrics obtained in Examples 6 to 10 are better in texture, degree of bulkiness, water absorbency, and drying performance than the interlock knitted fabric of Comparative Example 7 produced by using a typical cotton spun yarn that is not bulked.

Example 11

By using the processed spun yarn (E2) obtained in Example 2 as a pile yarn and a 20-count single spun yarn ("TS20 single yarn" manufactured by Tsuzuki Spinning Co., Ltd.) made of 100% cotton fiber and having the number of twists of 600 twists/m (Z twist) as a ground yarn, a pile knitted fabric was produced with a 20G sinker pile knitting machine (sinker height: 1.7 mm). The obtained pile knitted fabric was scoured in a bath by a continuous scouring machine at 95° C., and dried by a hot air dryer at 150° C. Results of evaluation or measurement of the texture, degree of bulkiness, pilling, water absorbency, drying performance, and fluff-shedding properties of the obtained pile knitted fabric are shown in Table 6.

Comparative Example 8

By using 20-count single spun yarns ("TS20 single yarn" manufactured by Tsuzuki Spinning Co., Ltd.) made of 100% cotton fiber and having the number of twists of 600 twists/m (Z twist) as a pile yarn and a ground yarn, a pile knitted fabric was produced with a 20G sinker pile knitting machine (sinker height: 1.7 mm). The obtained pile knitted fabric was scoured in a bath by a continuous scouring machine at 95° C., and dried by a hot air dryer at 150° C. Results of evaluation or measurement of the texture, degree of bulkiness, water absorbency, drying performance, and fluff-shedding properties of the thus obtained pile knitted fabric are shown in Table 6.

TABLE 6

| | Details of knitted fabric | | | Physical properties of knitted fabric | | | | |
|---|---|---|---|---|---|---|---|---|
| | Kind | Pile yarn | Ground yarn | Texture | Degree of bulkiness | Water absorbency | Drying performance | Fluff-shedding ratio |
| Example 11 | Pile knitted fabric | E2 | 20-count cotton single yarn | 5.0 | 180% | <1 sec. | 11% | 0.06% |
| Comparative Example 8 | Pile knitted fabric | 20-count cotton single yarn | 20-count cotton single yarn | 3 (Standard) | 100% (Standard) | 5 sec. | 29% | 0.11% |

As apparent from Table 6, in Example 11, the pile knitted fabric produced by using the processed spun yarn (bulked spun yarn) obtained in Example 2 as a pile yarn and a cotton single spun yarn as a ground yarn, is better in all of texture, degree of bulkiness, water absorbency, and drying performance, and smaller in fluff-shedding ratio than the pile knitted fabric produced in Comparative Example 8 by using cotton single spun yarns as a pile yarn and a ground yarn.

Example 12

By using a two ply yarn of 40-count cotton single spun yarns obtained in Comparative Example 3 as warp yarns and the processed spun yarn (E2) obtained in Example 2 as weft yarns, a ⅓ twill woven fabric having 24 warp yarns/cm and 23 weft yarns/cm [the proportion of the processed spun yarn (E2) in the woven fabric was 45 mass] was produced, and the obtained woven fabric was scoured in a bath by a continuous scouring machine at 95° C. and dried by a hot air dryer at 150° C. Results of evaluation or measurement of the texture, degree of bulkiness, pilling, water absorbency, and drying performance of the obtained woven fabric are shown in Table 7.

Comparative Example 9

By using a two ply yarn of 40-count cotton single spun yarns as warp yarns and a 20-count single spun yarn ("TS20 single yarn" manufactured by Tsuzuki Spinning Co., Ltd.) made of 100% cotton fiber and having the number of twists of 600 twists/m (Z twist) as weft yarns, a ⅓ twill woven fabric having 24 warp yarns/cm and 23 weft yarns/cm was produced, and the obtained woven fabric was scoured in a bath by a continuous scouring machine at 95° C., and dried by a hot air dryer at 150° C. Results of evaluation or measurement of the texture, degree of bulkiness, pilling, water absorbency, and drying performance of the obtained woven fabric are shown in Table 7.

Reference Example 3

(1) By using a two ply yarn of 40-count cotton single spun yarns as warp yarns and using the composite twisted yarn obtained in (2) of Example 2 [composite twisted yarn produced by supplying one 20-count single spun yarn ("TS20 single yarn" manufactured by Tsuzuki Spinning Co., Ltd.) made of 100% cotton fiber and having the number of twists of 600 twists/m (Z twist) and one polyvinyl alcohol multifilament yarn ("Water-soluble vinylon" manufactured by KURARAY CO., LTD., that is a yarn soluble in water at 80° C., 38 dtex/12 filaments) to a double twister ("36M" manufactured by Murata Machinery, Ltd.) and twisting these yarns in the S direction at the number of twists (the number of final twists) of 900 twists/m] as weft yarns, a ⅓ twill woven fabric having 24 warp yarns/cm and 23 weft yarns/cm was produced.

(2) The woven fabric obtained in (1) above was immersed in hot water at 95° C. for 30 minutes to remove the water-soluble yarn (polyvinyl alcohol multifilament yarn) in the composite twisted yarn forming the woven fabric by dissolution, and then the woven fabric is taken out from the water and dried at 150° C. Results of evaluation or measurement of the texture, degree of bulkiness, pilling, water absorbency, and drying performance of the obtained woven fabric are shown in Table 7.

TABLE 7

| | Details of woven fabric | | | Physical properties of woven fabric | | | | |
|---|---|---|---|---|---|---|---|---|
| | Kind | Kind of yarn | Removal of water-soluble yarn by dissolution | Texture | Degree of bulkiness | Pilling | Water absorbency | Drying performance |
| Example 12 | ⅓ twill woven fabric | Warp: 40-count cotton two ply yarn Weft: E2 (45%) | In the state of yarn | 4.8 | 170% | 4 | <1 sec. | 12% |
| Comparative Example 9 | ⅓ twill woven fabric | Warp: 40-count cotton two ply yarn Weft: 20-count cotton single yarn | — | 3 (Standard) | 100% (Standard) | 4 | 5 sec. | 27% |
| Reference Example 3 | ⅓ twill woven fabric | Warp: 40-count cotton two ply yarn Weft: composite twisted yarn obtained in (2) of Example 2 | After weaving | 4.2 | 140% | 4 | 3 sec. | 17% |

As apparent from Table 7, in Example 12, the ⅓ twill woven fabric was produced by using a two ply yarn of 40-count cotton single spun yarns as warp yarns and the processed spun yarn (E2) obtained in Example 2 as weft yarns, and accordingly, the obtained twill woven fabric was better in texture, degree of bulkiness, water absorbency, and drying performance than the twill woven fabric obtained in Reference Example 3 by producing ⅓ twill woven fabric from a 40-count cotton two ply yarn as warp yarns and the composite twisted yarn obtained in (2) of Example 2 as weft yarns and then removing the water-soluble yarn in the twill woven fabric by dissolution in water.

In addition, the twill woven fabric obtained in Example 12 is better in texture, degree of bulkiness, water absorbency, and drying performance than the twill woven fabric of Comparative Example 9 produced by using a typical cotton spun yarn that is not bulked.

[3] Production of processed spun yarn and knit fabric

Example 13

(1) Two composite twisted yarns obtained in (2) of Example 2 [composite twisted yarns each produced by supplying one 20-count single spun yarn ("TS20 single yarn" manufactured by Tsuzuki Spinning Co., Ltd.) made of 100% cotton fiber and having the number of twists of 600 twists/m (Z twist) and one polyvinyl alcohol multifilament yarn ("Water-soluble vinylon" manufactured by KURARAY CO., LTD., that is a yarn soluble in water at 80° C., 38 dtex/12 filaments) to a double twister ("36M" manufactured by Murata Machinery, Ltd.) and twisted in the S direction at the number of twists (the number of final twists) of 900 twists/m], were supplied to a double twister ("36M" manufactured by Murata Machinery, Ltd.) and twisted in the Z direction at the number of twists of 180 twists/m to produce a two ply yarn of the composite twisted yarns.

(2) The two ply yarn of the composite twisted yarns obtained in (1) described above was wound up around a dyeing bobbin and compressed from above to have a fiber density of 0.3 g/cm$^3$, the wound up two ply yarn was put into a pot of a dyeing machine and treated in hot water at 95° C. for 15 minutes to remove the water-soluble yarns in the composite twisted yarns, and then thoroughly washed with water at 50° C., and dried with hot air at 90° C. for 90 minutes to produce a processed spun yarn (E13).

(3) Results of measurement or evaluation of the ratio of an average diameter of the processed spun yarn (E13) obtained in (2) described above to an average diameter of a two ply yarn of single spun yarns [produced by supplying two 20-count two-folded spun yarns ("TS20 single yarn" manufactured by Tsuzuki Spinning Co., Ltd.) made of 100% cotton fiber and having the number of twists of 600 twists/m (Z twist) to a double twister ("36M" manufactured by Murata Machinery, Ltd.) and twisting these yarns in the S direction at the number of twists (the number of final twists) of 180 twists/m] used for producing the composite twisted yarn, and texture of the processed spun yarn, are shown in Table 8.

TABLE 8

| | Two ply yarn of composite twisted yarns | | Processed spun yarn | | |
|---|---|---|---|---|---|
| | Details of composite twisted yarns | Number of twists (twisting direction) | Symbol | Diameter ratio (after removal/before removal) | Texture |
| Example 13 | Composite twisted yarns obtained in (2) of Example 2 | 180 (Z) | E13 | 1.3 | 4.6 |

As apparent from Table 8, in Example 13, in the composite twisted yarn obtained by twisting a single spun yarn and a water-soluble yarn in a direction opposite to the twisting direction of the single spun yarn, the number of twists of the composite twisted yarn was within the range of 1.3 to 3 times the number of twists of the single spun yarn, the proportion of the single spun yarn was within the range of 98 to 20 mass % and the proportion of the water-soluble yarn was within the range of 2 to 80 mass %, so that the bulked spun yarn that was bulkier (bulked), softer, and better in texture than the original single spun yarn was obtained.

Example 14

An interlock knitted fabric was knitted with a 14G×30-inch circular knitting machine by using singly the processed spun yarn (E13) obtained in Example 13, and the obtained interlock knitted fabric was scoured in a bath by a continuous scouring machine at 95° C. and dried by a hot air dryer at 150° C. Results of evaluation or measurement of the texture, degree of bulkiness, pilling, water absorbency, and drying performance of the thus obtained interlock knitted fabric are shown in Table 9.

Comparative Example 10

An interlock knitted fabric was knitted with a 14G×30-inch circular knitting machine by using only a two ply yarn of 20-count single spun yarns made of 100% cotton fiber and having the number of twists of 600 twists/m (Z twist) [produced by supplying two 20-count single spun yarns ("TS20 single yarn" manufactured by Tsuzuki Spinning Co., Ltd.) to a double twister ("36M" manufactured by Murata Machinery, Ltd.) and twisting these yarns in the S direction at the number of twists (the number of final twists) of 180 twists/m], and the obtained interlock knitted fabric was scoured in a bath by a continuous scouring machine at 95° C. and dried by a hot air dryer at 150° C. Results of evaluation or measurement of the texture, degree of bulkiness, pilling, water absorbency, and drying performance of the thus obtained interlock knitted fabric are shown in Table 9.

TABLE 9

| | Details of knit fabric | | | Physical properties of knit fabric | | | | |
|---|---|---|---|---|---|---|---|---|
| | Kind | Kind of yarn | Removal of water-soluble yarn by dissolution | Texture | Degree of bulkiness | Pilling | Water absorbency | Drying performance |
| Example 14 | Interlock knitted fabric | E13: 100% | In the state of yarn | 4.8 | 170% | 4 | <1 sec. | 15% |
| Comparative Example 10 | Interlock knitted fabric | 20-count cotton two ply yarn | — | 3 (Standard) | 100% (Standard) | 4.5 | 5 sec. | 30% |

As apparent from Table 9, in Example 14, the interlock knitted fabric was produced by using singly the processed spun yarn (E13) (bulked spun yarn) obtained in Example 13, and the interlock knitted fabric obtained in Example 14 is better in texture, degree of bulkiness, water absorbency, and drying performance than the interlock knitted fabric of Comparative Example 10 produced by using a two ply yarn obtained by twisting two typical cotton spun yarns that are not bulked.

INDUSTRIAL APPLICABILITY

The bulked yarn according to the present invention is very bulky, soft, and excellent in texture, air permeability, heat-insulating properties, and water absorbency, sheds no fluff, and has excellent weaving and knitting properties as compared with the original spun yarn. The woven or knit fabric obtained by using the bulked yarn according to the present invention is lightweight but voluminous, soft with an excellent touch, and excellent in heat-insulating properties and air permeability, hardly causes pilling, sheds no fluff, and has high water absorbency. By taking advantage of these properties, the woven or knit fabric according to the present invention can be widely and effectively used for sportswear, underwear, a foundation garment, jeans, outerwear, and other clothes, medical uses such as elastic wrap, vehicle interior materials, belt conveyor fabric, and other industrial materials, etc.

The invention claimed is:

1. A method for producing a bulked yarn comprising bulked single spun yarn, the method comprising:

dissolving and removing a water-soluble yarn from at least one composite twisted yarn comprising a single spun yarn and the water-soluble yarn, which are twisted together in a direction opposite to a twisting direction of the single spun yarn, in a hydrophilic solvent, to produce a bulked single spun yarn, wherein when a sample of the bulked yarn having a length of 100 cm is hung down in a state where both ends of the yarn are fixed at a distance of 10 cm from each other in a direction perpendicular to the direction of gravitational force, twisting does not occur or an average value of the distances from the uppermost end of a twisting section to the first and second fixed ends of the yarn is 30 cm or more.

2. The method claim 1, wherein the bulked single spun yarn has a diameter of 1.2 or more times the diameter of the single spun yarn before bulking.

3. The method of claim 1, wherein the bulked single spun yarn is usable without heat treatment for reducing the torque.

4. The method of claim 1, wherein the bulked single spun yarn has a B value expressed by the following equation of 3 to 8:

$$B=(N2/N1)\times(D2/D1)^2$$

wherein:

N1 is the number of twists of the single spun yarn;

N2 is the number of twists of the composite twisted yarn;

D1 is an average diameter of the single spun yarn; and

D2 is an average diameter of the bulked single spun yarn.

5. The method of claim 1, wherein the bulked single spun yarn consists essentially of the bulked single spun yarn.

6. The method of claim 1, wherein the composite twisted yarn is obtained by doubling or twisting at least two composite twisted yarns together.

7. The method of claim 1, further comprising doubling or twisting the composite twisted yarn and another yarn together prior to dissolving and removing the water-soluble yarn in the hydrophilic solvent from the composite twisted yarn.

8. The method of claim 1, wherein the number of twists of the composite twisted yarn is 1.3 to 3 times the number of twists of the single spun yarn, and a mass ratio of the single spun yarn to the water-soluble yarn is 98/2 to 20/80.

9. The method of claim 1, wherein the hydrophilic solvent is water.

10. The method of claim 1, wherein the hydrophilic solvent comprises water.

11. The method of claim 1, wherein the hydrophilic solvent comprises at least one member selected from the group consisting of an alcohol, a ketone, an ether, a cellosolve, and a carbitol.

12. The method of claim 1, wherein the hydrophilic solvent comprises at least one member selected from the group consisting of methanol, ethanol, isopropanol, acetone, tetrahydrofuran, methyl cellosolve, ethyl cellosolve, carbitol and diethyleneglycol dimethyl ether.

13. The method of claim 1, wherein the bulked single spun yarn has a smaller torque than the composite twisted yarn before the water-soluble yarn is removed.

14. The method of claim 1, wherein the bulked single spun yarn is suitable for producing a woven or knit fabric.

15. The method of claim 1, wherein the bulked single spun yarn is composed of synthetic fibers and natural fibers.

16. The method of claim 1, wherein the bulked single spun yarn is composed of polyester-series fibers and at least one of cotton fibers and wool fibers.

17. The method of claim 1, wherein the water-soluble yarn comprises at least one of a polyvinyl-series resin and a water-soluble polyamide series resin.

18. The method of claim 1, wherein the dissolving and removing a water-soluble yarn is conducted at a temperature of 85 to 100° C.

19. A method for producing a woven or knit fabric from a bulked yarn comprising bulked single spun yarn, comprising:

(a) dissolving and removing a water-soluble yarn from at least one composite twisted yarn comprising a single spun yarn and the water-soluble yarn, which are twisted together in a direction opposite to a twisting direction of the single spun yarn, in a hydrophilic solvent, to produce a bulked single spun yarn, wherein when a sample of the bulked yarn having a length of 100 cm is hung down in a state where both ends of the yarn are fixed at a distance of 10 cm from each other in a direction perpendicular to the direction of gravitational force, twisting does not occur or an average value of the distances from the uppermost end of a twisting section to the first and second fixed ends of the yarn is 30 cm or more; and (b) producing a woven or knit fabric comprising the bulked single spun yarn.

* * * * *